US007370948B2

(12) United States Patent
Inoue

(10) Patent No.: US 7,370,948 B2
(45) Date of Patent: May 13, 2008

(54) IMAGE RECORDING APPARATUS

(75) Inventor: Hiroshi Inoue, Kanagawa (JP)

(73) Assignee: Fujifilm Corporation, Tokyo (JP)

( * ) Notice: Subject to any disclaimer, the term of this patent is extended or adjusted under 35 U.S.C. 154(b) by 243 days.

(21) Appl. No.: 11/373,253

(22) Filed: Mar. 13, 2006

(65) Prior Publication Data

US 2006/0203026 A1 Sep. 14, 2006

(30) Foreign Application Priority Data

Mar. 14, 2005 (JP) ..... 2005-071587

(51) Int. Cl.
*B41J 2/17* (2006.01)
*B41J 2/165* (2006.01)

(52) U.S. Cl. ..... 347/84; 347/33

(58) Field of Classification Search ..... 347/73, 347/74, 84, 85, 33, 34, 36, 37
See application file for complete search history.

(56) References Cited

U.S. PATENT DOCUMENTS 6,545,694 B1 * 4/2003 Yamaguchi ..... 347/171

FOREIGN PATENT DOCUMENTS

JP 10-86353 A 4/1998

JP 2001-179959 A 7/2001

* cited by examiner

*Primary Examiner*—K. Feggins
(74) *Attorney, Agent, or Firm*—Birch, Stewart, Kolasch & Birch, LLP

(57) ABSTRACT

The image recording apparatus comprises: a liquid ejection head which ejects liquid onto a recording medium; a conveyance device which relatively conveys the recording medium with respect to the liquid ejection head, by moving at least one of the recording medium and the liquid ejection head; a liquid removal device which is provided after the liquid ejection head in terms of a conveyance direction of the recording medium and removes the liquid on the recording medium; a recording medium determination device which determines a type of the recording medium; a liquid volume determination device which determines a volume of the liquid on the recording medium; a liquid volume threshold value establishment device which establishes a liquid volume threshold value in accordance with the type of the recording medium determined by the recording medium determination device; and a liquid removal control device which controls the liquid removal device in accordance with a comparison between the volume of the liquid on the recording medium determined by the liquid volume determination device and the liquid volume threshold value established by the liquid volume threshold value establishment device.

16 Claims, 20 Drawing Sheets

FIG.10

| MEDIA TYPE | SOLVENT VOLUME THRESHOLD VALUE | PERMEATION TIME THRESHOLD VALUE |
|---|---|---|
| PPC PAPER (NORMAL PAPER) | 8ml/$m^2$ | 1sec |
| ART PAPER / COATED PAPER | 5ml/$m^2$ | 5sec |
| PHOTOGRAPHIC PAPER | 25ml/$m^2$ | 10sec |
| OHP SHEET | 0 | -(INFINITY) |

IMAGE RECORDING APPARATUS

BACKGROUND OF THE INVENTION

1. Field of the Invention

The present invention relates to an image recording apparatus, and more particularly, to liquid removal technology that prevents the occurrence of cockling by effectively removing surplus liquid on a recording medium.

2. Description of the Related Art

In recent years, inkjet recording apparatuses have come to be used widely as data output apparatuses for outputting images, documents, or the like. An inkjet recording apparatus ejects ink from nozzles by driving actuators corresponding to nozzles provided in a print head in accordance with data, and thereby forms an image, document, or the like, corresponding to the data, on a recording medium.

Inkjet recording apparatuses often use water-based inks in which coloring material and additives are mixed with a solvent of water, from the viewpoint of easy handling. Water-based ink permeates into the media, and if the amount of permeated ink exceeds a prescribed volume, then cockling (wrinkling) occurs on the media. If cockling of this kind occurs, then the media may make contact with a print head, thereby giving rise to a paper jam. Furthermore, if the ink ejection volume exceeds the volume of the permeation tolerance of the media, then ink remains on the surface of the media. If this residual ink makes contact with another media, then it may cause reverse-side marks or soiling of the images on other media. On the other hand, the treatment liquid is also a water-based liquid which has water as a solvent in a system which, in order to achieve compatibility with a wide range of media, separates the solvent from the coloring material of the ink (causing the coloring material to aggregate) by making a treatment liquid and ink react with each other on the surface of a medium (for example, coated paper, sheets for overhead projectors (OHP), or the like) into which ink (solvent) does not permeate, and thereby the coloring material is fixed on the surface of the media. In such a system, a large amount of solvent (ink solvent and treatment liquid solvent) may be present on the media. Consequently, in a system of this kind, it is necessary to remove the solvent (liquid) from the media, swiftly.

Japanese Patent Application Publication No. 2001-179959 discloses the ink absorbing body, and the image forming apparatus and method using an ink absorbing body. The ink absorbing body includes a liquid solvent absorbing body and a separating member. The separating member covers the surface of the liquid solvent absorbing body at least partially, and has properties of allowing the ink solvent to pass and properties of releasing the coloring material of the ink. If ink is deposited on a sheet, then the liquid solvent absorbing body is moved in closed proximity to a portion of the sheet, via the separating member. Then, the liquid solvent is absorbed into the liquid solvent absorbing body via the separating member, in such a manner that the coloring material and the liquid solvent of the liquid ink on the sheet are mutually separated.

Furthermore, Japanese Patent Application Publication No. 10-86353 discloses the inkjet recording apparatus including a single halogen heater and a semi-cylindrical reflecting plate that covers the exterior of this heater. The halogen heater and the semi-cylindrical reflecting plate are disposed below the platen which opposes the recording head, in such a manner that pre-heating, main heating, and after-heating are carried out with respect to a recording medium conveyed on the platen, by means of the single heater.

However, in the ink absorbing body, the image forming apparatus, and the image forming method disclosed in Japanese Patent Application Publication No. 2001-179959, though unnecessary solvent is gathered by a solvent absorbing member; there is no specific disclosure regarding the time until removal of the solution, and the relationship between solution removal and the type of medium. Thus, the disclosure of Japanese Patent Application Publication No. 2001-179959 is not sufficient in terms of preventing cockling.

In the inkjet recording apparatus disclosed in Japanese Patent Application Publication No. 10-86353, the amount of heat required to remove the solution increases when the amount of solution on the recording medium increases, and consequently, a large halogen heater is required. Moreover, there is no specific disclosure regarding the time until removal of solution, and the relationship between the type of the medium and the solution removal.

SUMMARY OF THE INVENTION

The present invention is contrived in view of the foregoing circumstances, an object thereof being to provide an image recording apparatus that prevents the occurrence of cockling by efficiently removing solvent remaining on a media.

In order to attain the aforementioned object, the present invention is directed to an image recording apparatus, comprising: a liquid ejection head which ejects liquid onto a recording medium; a conveyance device which relatively conveys the recording medium with respect to the liquid ejection head, by moving at least one of the recording medium and the liquid ejection head; a liquid removal device which is provided after the liquid ejection head in terms of a conveyance direction of the recording medium and removes the liquid on the recording medium; a recording medium determination device which determines a type of the recording medium; a liquid volume determination device which determines a volume of the liquid on the recording medium; a liquid volume threshold value establishment device which establishes a liquid volume threshold value in accordance with the type of the recording medium determined by the recording medium determination device; and a liquid removal control device which controls the liquid removal device in accordance with a comparison between the volume of the liquid on the recording medium determined by the liquid volume determination device and the liquid volume threshold value established by the liquid volume threshold value establishment device.

According to this aspect of the present invention, the threshold value of the volume of the liquid on the recording medium is set in accordance with the type of the recording medium, and the liquid removal device is controlled in accordance with a comparison between this liquid threshold value and the liquid volume on the recording medium. Hence, desirable liquid removal that is suited to the type of the recording medium is implemented, and it is therefore possible to prevent the occurrence of cockling on the recording medium that causes deterioration of the image. Furthermore, solvent removal matched to the recording medium is carried out, and hence improved efficiency in drying can be expected, as the drying time of the recording medium is shortened and the power consumption of the drying device for drying the recording medium is reduced.

The liquid ejected from the liquid ejection head contains a recording material, such as ink containing an ink coloring material. Furthermore, the "liquid" referred to here may also include a treatment liquid that causes the coloring material in the ink to aggregate by reacting with the ink. In other words, the liquid ejection head may include an inkjet head that ejects ink, and a treatment liquid that reacts with the ink.

The liquid volume may be the solvent volume in the liquid, such as ink and treatment liquid, present on the recording medium, or it may be the liquid volume including the solute (ink coloring material) on the recording medium. In other words, the liquid volume on the recording medium may be derived from the liquid ejection volume, on the basis of the image data (dot data). Furthermore, it is also possible to determine the solvent volume (e.g., the solvent volume is calculated by subtracting the volume of solute from the liquid volume), on the basis of the ejection volume, instead of the liquid ejection volume itself. Furthermore, the liquid volume on the recording medium may also include liquid other than the liquid ejected from the liquid ejection head (for example, a liquid applied to the recording medium by means of an application device, such as a roller).

The liquid removal device includes an absorbing member (liquid absorbing body) which absorbs the liquid from the recording medium, by making contact with the liquid (in other words, removes the liquid by contact). A porous member or polymer, or the like, may be used suitably as the absorbing member. When the liquid is removed, the liquid removal device may be placed in contact with the liquid on the surface of the recording medium, and an increase in the liquid removal efficiency can be expected by placing the liquid removal device in contact with the recording medium. Moreover, if the liquid removal device makes contact with the recording medium at a prescribed pressure, then further improvement in liquid removal efficiency can be expected.

The liquid ejection head may be a line type head. The line type head may have an ejection hole row constituted by a plurality of ejection ports that eject liquid are arranged, and may have a length corresponding to the full width of the recording medium or the image recordable width thereof (the length in the width direction of the recording medium on which an image can be formed). The liquid ejection head may be a serial type head in which a short head having a length that does not reach the full width or the image recordable width of the recording medium is scanned (moved) in the direction of the full width or the image recordable width of the recording medium.

A line type ejection head may be formed to a length corresponding to the full width or the image recordable width of the recording medium by combining short heads having a row of ejection holes which do not reach a length corresponding to the full width or image recordable width of the ejection receiving medium, these short heads being joined together in a staggered matrix fashion.

Moreover, "recording medium" indicates a medium (media) which receives a liquid ejected by a liquid ejection head, and includes various types of media, irrespective of material and size, such as continuous paper, cut paper, sealed paper, resin sheets such as OHP sheets, film, cloth, and other materials.

The mode of determining the type of the recording medium by the recording medium determination device may involve the operator (user) directly inputting the type of the recording medium (recording medium information). Alternatively, the recording medium may be directly read in by means of a determination device, such as a sensor or imaging element, the type of recording medium being determined automatically on the basis of the results thus read in. Furthermore, it is also possible to adopt a system in which an information recording body (memory, IC tag, or the like) which stores information including information on the recording medium is provided in the supply device which supplies the recording medium, in such a manner that the type of the recording medium (media type) is read in from this information recording body.

The liquid volume threshold value established by the liquid volume threshold value establishment device may be previously organized in the form of a data table including the values corresponding to the type of the recording medium, and stored in a storage device.

Preferably, the image recording apparatus further comprises an ejection control device which controls a volume of the liquid ejected from the liquid ejection head, in such a manner that, if the volume of the liquid on the recording medium determined by the liquid volume determination device exceeds the liquid volume threshold value, then the volume of the liquid ejected from the liquid ejection head becomes equal to or lower than the liquid volume threshold value.

Since the control is implemented in such a manner that the liquid volume ejected from the liquid ejection head does not exceed the liquid volume threshold value, then it is possible to obtain a high-quality recorded image, while the occurrence of unacceptable cockling on the recording medium can be prevented.

In order to attain the aforementioned object, the present invention is also directed to an image recording apparatus, comprising: a liquid ejection head which ejects liquid onto a recording medium; a conveyance device which relatively conveys the recording medium with respect to the liquid ejection head, by moving at least one of the recording medium and the liquid ejection head; a liquid removal device which is provided after the liquid ejection head in terms of a conveyance direction of the recording medium and removes the liquid on the recording medium; a recording medium determination device which determines a type of the recording medium; a liquid removal time calculation device which calculates a liquid removal time until the liquid ejected from the liquid ejection head is removed from the recording medium; a liquid removal time threshold value establishment device which establishes a threshold value for the liquid removal time in accordance with the type of the recording medium determined by the recording medium determination device; and a conveyance control device which controls a conveyance speed of the recording medium in accordance with a comparison between the liquid removal time calculated by the liquid removal time calculation device and the liquid removal time threshold value established by the liquid removal time threshold value establishment device.

According to this aspect of the present invention, the liquid removal time until liquid that has been ejected from the liquid ejection head is removed from the recording medium, is calculated by the liquid removal time calculation device; a threshold value for the liquid removal time is established by the liquid removal time threshold value establishment device in accordance with the type of the recording medium determined by the recording medium determination device; and the conveyance speed of the recording medium (conveyance device) is controlled on the basis of a comparison between the liquid removal time calculated by the liquid removal time calculation device and the liquid removal time threshold value established by the liquid removal time threshold value establishment device. Therefore, the solvent removal is carried out in a shorter period of time than the liquid removal time threshold value.

More specifically, in a case of a recording medium which has a fast liquid permeation speed (in which the liquid on the recording medium permeates in a relatively short time period), it is possible to raise the conveyance speed of the recording medium, and thereby to remove the liquid on the recording medium before the liquid permeates into the recording medium. Therefore, it is possible to prevent the occurrence of cockling of an unacceptable level, even when a recording medium having a fast liquid permeation speed of this kind is used.

The "liquid removal time" shows the time until the liquid is removed from the recording medium by means of the solvent removal device, after the liquid has been landed onto the recording medium. The liquid removal time is dependent on the conveyance speed of the recording medium. If the conveyance speed (linear speed) of the recording medium is increased, then the liquid removal time is shortened. If the conveyance speed of the recording medium is slowed down, then the solvent removal time is increased.

Preferably, the image recording apparatus further comprises an ejection control device which controls an ejection frequency of the liquid ejection head in accordance with the conveyance speed of the recording medium.

An ejection frequency determination device which determines whether the ejection frequency changed in accordance with the conveyance speed of the recording medium is greater than the maximum allowable ejection frequency of the liquid ejection head or not, may be provided. If the changed ejection frequency is greater than the maximum allowable ejection frequency of the liquid ejection head, then control is implemented in such a manner that a report is issued indicating that the ejection frequency should not be changed in accordance with the conveyance speed of the recording medium.

In order to attain the aforementioned object, the present invention is also directed to an image recording apparatus, comprising: a liquid ejection head which ejects liquid onto a recording medium; a conveyance device which relatively conveys the recording medium with respect to the liquid ejection head, by moving at least one of the recording medium and the liquid ejection head; a liquid removal device which is provided after the liquid ejection head in terms of a conveyance direction of the recording medium and removes the liquid on the recording medium; a recording medium determination device which determines a type of the recording medium; a liquid volume determination device which determines a volume of the liquid on the recording medium; a liquid volume threshold value establishment device which establishes a liquid volume threshold value in accordance with the type of the recording medium determined by the recording medium determination device; a liquid removal control device which controls the liquid removal device in accordance with a comparison between the volume of the liquid on the recording medium determined by the liquid volume determination device, and the liquid volume threshold value established by the liquid volume threshold value establishment device; a liquid removal time calculation device which calculates a liquid removal time until the liquid ejected from the liquid ejection head is removed from the recording medium; a liquid removal time threshold value establishment device which establishes a threshold value for the liquid removal time in accordance with the type of the recording medium determined by the recording medium determination device; and a conveyance control device which controls a conveyance speed of the recording medium in accordance with a comparison between the liquid removal time calculated by the liquid removal time calculation device and the liquid removal time threshold value established by the liquid removal time threshold value establishment device.

According to this aspect of the present invention, the liquid removal device is controlled on the basis of a comparison between the liquid volume threshold value established in accordance with the type of the recording medium, and the liquid volume ejected by the liquid ejection head, and the conveyance speed of the recording medium is controlled on the basis of a comparison between the liquid removal time threshold value established in accordance with the type of the recording medium and the liquid removal time. Accordingly, desirable liquid removal can be carried out in accordance with the type of the recording medium, and a prescribed quality can be ensured in the image recorded on the recording medium.

Preferably, the image recording apparatus further comprises an ejection control device which controls a volume of the liquid ejected from the liquid ejection head, in such a manner that, if at least one of a condition where the volume of the liquid determined by the liquid volume determination device exceeds the liquid volume threshold value, and a condition where the liquid removal time calculated by the liquid removal time calculation device exceeds the threshold value for the liquid removal time, is satisfied, then the volume of the liquid ejected from the liquid ejection head becomes equal to or lower than the liquid volume threshold value.

By controlling the liquid volume on the recording medium by reducing the volume of the liquid ejected from the liquid ejection head, it is possible to reduce cockling even in a high-density region where the ink volume is high.

Preferably, the ejection control device controls an ejection frequency of the liquid ejection head in accordance with the conveyance speed of the recording medium.

Preferably, the image recording apparatus further comprises a dividing device which divides a region on the recording medium into a plurality of blocks, the region having possibility of receiving the ejected liquid; wherein the liquid volume determination device determines the volume of the liquid ejected from the liquid ejection head, for each of the blocks of the recording medium obtained by the dividing device; and the liquid removal control device performs control in such a manner that a liquid removal is carried out in accordance with the volume of the liquid determined for each of the blocks.

The region of the recording medium onto which liquid can be ejected is divided into a plurality of the blocks, and the solvent removal is carried out for each block by determining the liquid ejection volume in each block. Accordingly, increased lifespan of the liquid removal device can be expected. Furthermore, the liquid removal can be controlled in a detailed fashion, with respect to each block.

For example, a region having a high liquid volume is extracted from on the basis of ejection data, and this extracted region may be divided into a plurality of blocks, or alternatively, the whole image may be divided into a plurality of blocks. The "ejection data" corresponds to the "image data" in an inkjet recording apparatus that forms images by means of ink, for example. According to this aspect, liquid can be removed in accordance with the contents of the image.

Preferably, a plurality of the liquid removal devices which are arranged in a direction substantially perpendicular to a direction in which the recording medium is relatively conveyed, are provided; and the liquid removal control device performs control in such a manner that a liquid removal is carried out for each of the liquid removal devices.

The liquid removal device assembly is divided in a direction substantially perpendicular to the conveyance direction of the recording medium, thereby achieving a composition in which liquid can be removed independently by the divided liquid removal devices. Hence, it is possible to achieve desirable liquid removal in accordance with the distribution of the liquid volume on the recording medium.

Furthermore, maintenance (replacement and the like) can be carried out independently for each of the divided liquid removal devices. According to this, improved maintenance characteristics can be expected and reduction in costs can also be anticipated because of unit-based design.

As an example of dividing the liquid removal device assembly in a direction substantially perpendicular to the conveyance direction of the recording medium, it is possible to arrange the divided liquid removal devices in a staggered fashion following the direction substantially perpendicular to the conveyance direction, or to arrange the divided liquid removal devices in one row. If the divided liquid removal devices are disposed in a staggered fashion, then adjacent liquid removal devices may be displaced so as to have a mutually overlapping region in their direction of alignment.

Preferably, a plurality of the liquid ejection heads are provided; and the liquid ejection heads include an ink ejection head which ejects ink and a treatment liquid ejection head which ejects treatment liquid that promotes fixing of the ink onto the recording medium.

In a two-liquid type of the inkjet recording apparatus which promotes the fixing of the ink by causing a treatment liquid to react with the ink, ink (ink solvent) and surplus treatment liquid that have not yet reacted are removed. Hence, improved drying efficiency of the recording medium can be expected and it is possible to prevent cockling of an unacceptable level from occurring on the recording medium. Particularly beneficial effects can be expected if the present invention is applied to a two-liquid type image recording apparatus that ejects a large amount of liquid (solvent) onto the recording medium.

According to the present invention, a liquid volume threshold value which is a threshold value of the liquid volume on the recording medium, is established in accordance with the type of the recording medium, and removal of the solvent from the recording medium is implemented on the basis of a comparison between this liquid volume threshold value and the liquid volume on the recording medium. Therefore, desirable solvent removal can be performed in accordance with the type of the recording medium, and cockling of an unacceptable level can be prevented on the recording medium. Furthermore, the solvent removal time threshold value corresponding to the liquid removal time until liquid is removed from the recording medium is established in accordance with the recording medium, and the conveyance speed of the recording medium is controlled on the basis of a comparison between the liquid removal time and the liquid removal time threshold value. Accordingly, it is possible to achieve desirable solvent removal, even when a recording medium having a high permeation speed is used. Furthermore, the drying time in a case of drying the recording medium can be shortened and the power consumption of the drying device can be reduced, and hence more efficient drying of the recording medium can be expected.

BRIEF DESCRIPTION OF THE DRAWINGS

The nature of this invention, as well as other objects and benefits thereof, is explained in the following with reference to the accompanying drawings, wherein:

FIG. 10 is a diagram showing specific examples of the solvent volume threshold value and the permeation time threshold value shown in FIG. 9;

DETAILED DESCRIPTION OF THE PREFERRED EMBODIMENTS

General Composition of Inkjet Recording Apparatus

Figure 1:
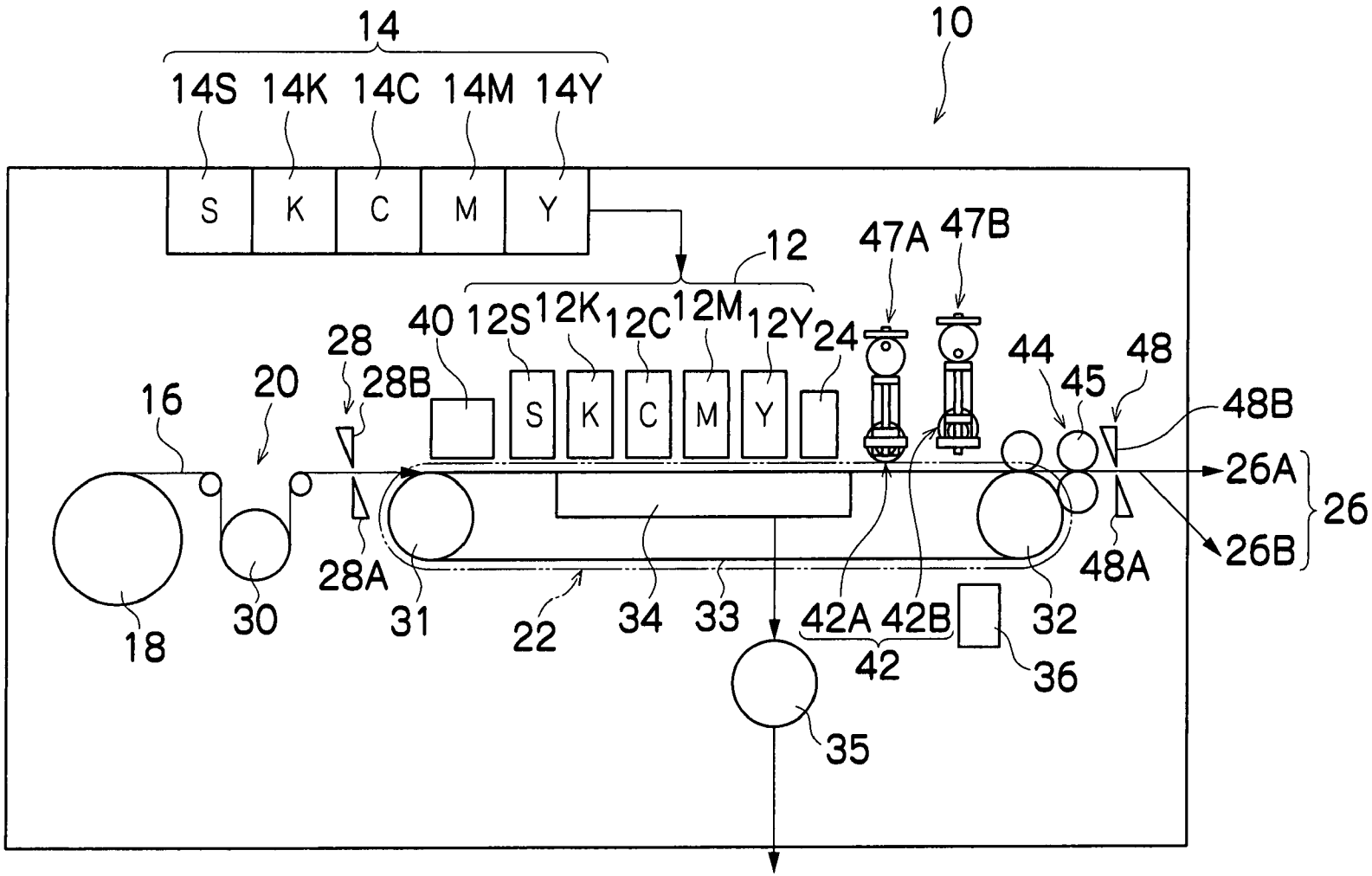
FIG. 1 is a general schematic drawing of an inkjet recording apparatus according to an embodiment of the present invention.

FIG. 1 is a diagram of the general composition of an inkjet recording apparatus according to an embodiment of the present invention. As shown in FIG. 1, this inkjet recording apparatus 10 comprises: a print unit 12 having a plurality of print heads 12K, 12C, 12M and 12Y provided for respective inks of the colors black (K), cyan (C), magenta (M) and yellow (Y), and, provided in a stage prior to the print heads 12K, 12C, 12M and 12Y, a treatment liquid ejection head 12S corresponding to a treatment liquid which promotes the fixing of the ink (causing the ink coloring material to aggregate) by reacting with the inks; a storing and loading unit 14 which stores ink corresponding to the print heads 12K,12C, 12M and 12Y of the respective colored inks, and treatment liquid corresponding to the treatment liquid ejection head 12S; a paper supply unit 18 which supplies recording paper 16 forming a recording medium; a decurling unit 20 which removes curl in the recording paper 16; a suction belt conveyance unit 22, disposed opposing the ink ejection surface of the print unit 12, which conveys recording paper 16 while keeping the recording paper 16 flat; a print determination unit 24 which reads out the print result created by the print unit 12; and a paper output unit 26 which outputs printed recording paper 16 (printed matter).

Below, the print heads 12K, 12C, 12M and 12Y, and the treatment liquid ejection head 12S are jointly referred to as heads (liquid ejection heads) 12S, 12K, 12C, 12M and 12Y.

In FIG. 1, a magazine for rolled paper (continuous paper) is shown as an embodiment of the paper supply unit 18; however, more magazines with paper differences such as paper width and quality may be jointly provided. Moreover, papers may be supplied with cassettes that contain cut papers loaded in layers and that are used jointly or in lieu of the magazine for rolled paper.

In the case of the configuration in which roll paper is used, a cutter (a first cutter) 28 is provided as shown in FIG. 1, and the continuous paper is cut to a desired size by the cutter 28. The cutter 28 has a stationary blade 28A, whose length is not less than the width of the conveyor pathway of the recording paper 16, and a round blade 28B, which moves along the stationary blade 28A. The stationary blade 28A is disposed on the reverse side of the printed surface of the recording paper 16, and the round blade 28B is disposed on the side adjacent to the printed surface across the conveyance path. When cut paper is used, the cutter 28 is not required.

In the case of a configuration in which a plurality of types of recording paper can be used, it is preferable that an information recording medium such as a bar code and a wireless tag containing information about the type of paper is attached to the magazine, and by reading the information contained in the information recording medium with a predetermined reading device, the type of paper to be used is automatically determined, and ink-droplet ejection is controlled so that the ink-droplets are ejected in an appropriate manner in accordance with the type of paper.

The recording paper 16 delivered from the paper supply unit 18 retains curl due to having been loaded in the magazine. In order to remove the curl, heat is applied to the recording paper 16 in the decurling unit 20 by a heating drum 30 in the direction opposite from the curl direction in the magazine. The heating temperature at this time is preferably controlled so that the recording paper 16 has a curl in which the surface on which the print is to be made is slightly round outward.

The decurled and cut recording paper 16 is delivered to the suction belt conveyance unit 22. The suction belt conveyance unit 22 (conveyance device) has a configuration in which an endless belt 33 is set around rollers 31 and 32 so that the portion of the endless belt 33 facing at least the ink (treatment liquid) ejection face of the printing unit 12 and the sensor face of the print determination unit 24 forms a horizontal plane (flat plane).

The belt 33 has a width that is greater than the width of the recording paper 16, and a plurality of suction apertures (not shown) are formed on the belt surface. A suction chamber 34 is disposed in a position facing the sensor surface of the print determination unit 24 and the nozzle surface of the printing unit 12 on the interior side of the belt 33, which is set around the rollers 31 and 32, as shown in FIG. 1. The suction chamber 34 provides suction with a fan 35 to generate a negative pressure, and the recording paper 16 on the belt 33 is held by suction.

The belt 33 is driven in the clockwise direction in FIG. 1 by the motive force of a motor 88 (not shown in FIG. 1, but shown in FIG. 6) being transmitted to at least one of the rollers 31 and 32, which the belt 33 is set around, and the recording paper 16 held on the belt 33 is conveyed from left to right in FIG. 1.

Since ink adheres to the belt 33 when a marginless print job or the like is performed, a belt-cleaning unit 36 is disposed in a predetermined position (a suitable position outside the printing area) on the exterior side of the belt 33. Although the details of the configuration of the belt-cleaning unit 36 are not shown, embodiments thereof include a configuration in which the belt 33 is nipped with cleaning rollers such as a brush roller and a water absorbent roller, an air blow configuration in which clean air is blown onto the belt 33, or a combination of these. In the case of the configuration in which the belt 33 is nipped with the cleaning rollers, it is preferable to make the line velocity of the cleaning rollers different from that of the belt 33 to improve the cleaning effect.

Instead of a suction belt conveyance unit 22, it might also be possible to use a roller nip conveyance mechanism, but since the print region passes through the roller nip, the printed surface of the paper makes contact with the rollers immediately after printing, and hence smearing of the image is liable to occur. Consequently, as shown in this embodiment, it is desirable to use suction belt conveyance in which the heads 12S, 12K, 12C, 12M, 12Y and recording paper 16 are mutually opposing and the heads do not make contact with the image surface in a print region (ejection region) where the recording paper 16 receives ejected droplets of treatment liquid and ink.

A heating fan 40 is disposed on the upstream side of the printing unit 12 in the conveyance pathway formed by the suction belt conveyance unit 22. The heating fan 40 blows heated air onto the recording paper 16 to heat the recording paper 16 immediately before printing so that the ink deposited on the recording paper 16 dries more easily.

Figure 2:
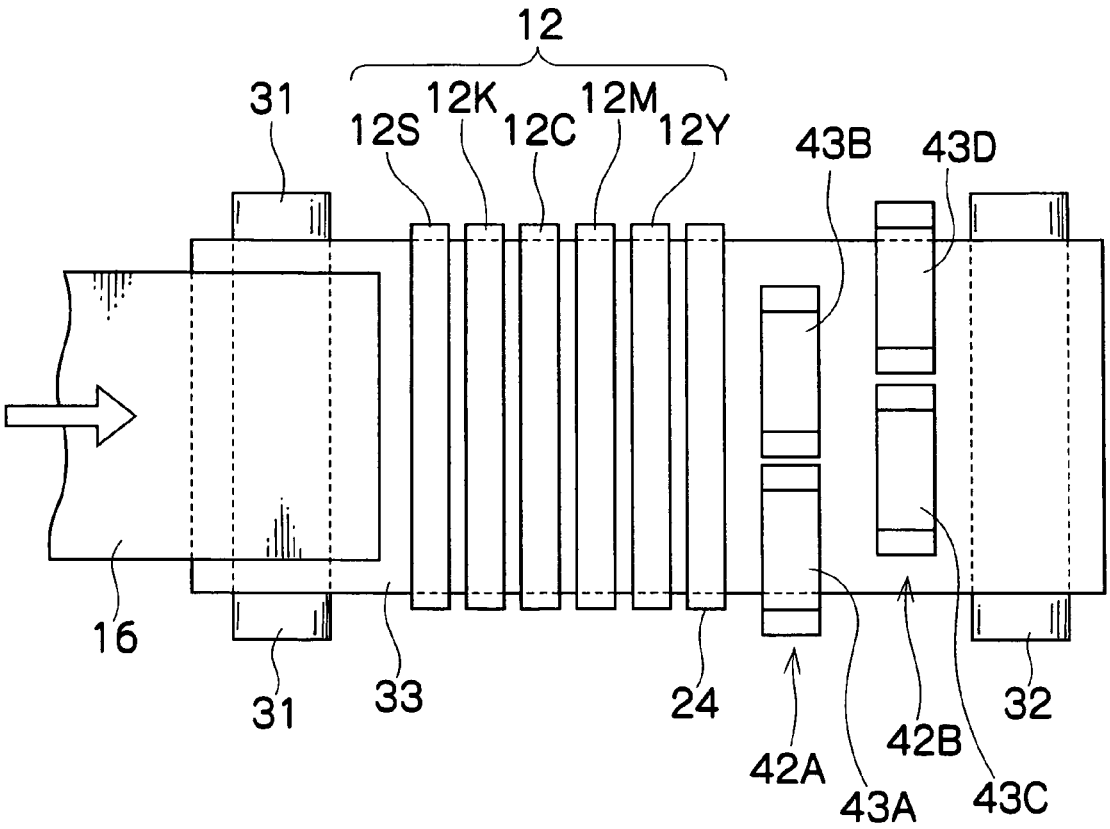
FIG. 2 is a principal plan diagram of the peripheral area of a print unit in the inkjet recording apparatus shown in FIG. 1.

The print unit 12 is a so-called "full line head" in which a line head having a length corresponding to the maximum paper width is arranged in a direction that is perpendicular to the paper feed direction (see FIG. 2). An embodiment of the detailed structure is described below, but each of the heads 12S, 12K, 12C, 12M, and 12Y is constituted by a line head, in which a plurality of nozzles are arranged along a length that exceeds at least one side of the maximum-size recording paper 16 intended for use in the inkjet recording apparatus 10, as shown in FIG. 2.

The treatment liquid ejection head 12S corresponding to the treatment liquid (S) and the print heads 12K, 12C, 12M, and 12Y corresponding to the respective colored inks are arranged in the order of the treatment liquid (S), black (K), cyan (C), magenta (M), and yellow (Y) from the upstream side, following the feed direction of the recording paper 16 (hereinafter, referred to as the paper feed direction). A color print can be formed on the recording paper 16 by ejecting treatment liquid from the treatment liquid ejection head 12S and by ejecting colored inks from the print heads 12K, 12C, 12M, and 12Y, respectively, onto the recording paper 16 while the recording paper 16 is conveyed.

The print unit 12, in which the full-line heads covering the entire width of the paper are thus provided for the respective ink colors, can record an image over the entire surface of the recording paper 16 by performing the action of moving the recording paper 16 and the print unit 12 relatively to each other in the sub-scanning direction just once (in other words, by means of a single sub-scan). Higher-speed printing is thereby made possible and productivity can be improved in comparison with a shuttle type head configuration in which a head moves reciprocally in the main scanning direction.

Although a configuration with four standard colors, K M C and Y, is described in the present embodiment, the combinations of the ink colors and the number of colors are not limited to these, and light and/or dark inks can be added as required. For example, a configuration is possible in which print heads for ejecting light-colored inks such as light cyan and light magenta are added.

Furthermore, the present embodiment describes a mode in which treatment liquid is ejected onto the recording paper 16 by means of a treatment liquid ejection head 12S, but it is also possible to apply the treatment liquid to the recording paper 16 by means of an application member, such as a roller, either instead of or in combination with the recording liquid ejection head 12S.

As shown in FIG. 1, the storing and loading unit 14 comprises a treatment liquid tank 14S corresponding to the recording liquid ejection head 12S, and ink supply tanks 14K, 14C, 14M and 14Y, which store colored inks corresponding to the respective print heads 12K, 12C, 12M, 12Y. The tanks are connected to the heads 12S, 12K, 12C, 12M, and 12Y, via prescribed tubing channels (not shown).

Furthermore, the ink storing and loading unit 14 also comprises a warning device (for example, a display device or an alarm sound generator) for warning when the remaining amount of any ink is low, and has a mechanism for preventing loading errors between inks of different colors and between the inks and treatment liquid.

The print determination unit 24 has an image sensor for capturing an image of the print result of the printing unit 12, and functions as a device to check for ejection defects such as clogs of the nozzles in the printing unit 12 from the image read by the image sensor.

The print determination unit 24 of the present embodiment is configured with at least a line sensor having rows of photoelectric transducing elements with a width that is greater than the treatment liquid and the ink-droplet ejection width (printable width) of the heads 12S, 12K, 12C, 12M, and 12Y. This line sensor has a color separation line CCD sensor including a red (R) sensor row composed of photoelectric transducing elements (pixels) arranged in a line provided with an R filter, a green (G) sensor row with a G filter, and a blue (B) sensor row with a B filter. Instead of a line sensor, it is possible to use an area sensor composed of photoelectric transducing elements which are arranged two-dimensionally.

The print determination unit 24 reads a test pattern image printed by the respective heads 12S, 12K, 12C, 12M, and 12Y, and determines the ejection from each head 12S, 12K, 12C, 12M and 12Y. The ejection determination includes the presence of the ejection, measurement of the dot size, and measurement of the dot landing position. Furthermore, it is also possible to judge the type of recording paper 16 from the reading results of the print determination unit 24.

A solvent removal unit 42 (liquid removal device) which removes the residual treatment liquid (the treatment liquid having not yet reacted) and ink solvent that remain on the recording paper 16 is disposed at a stage after the print determination unit 24 (on the downstream side in terms of the paper feed direction). In the present embodiment, the treatment liquid (solvent of the treatment liquid) and the ink solvent are often generally referred to simply as solvent (liquid). The solvent referred to here includes a liquid other than coloring material in the ink, and a liquid other than a polymer which becomes attached to the ink coloring material and consequently remains on the surface of the recording paper 16.

The solvent removal unit 42 comprises two absorbing roller modules 42A and 42B disposed following the paper feed direction (sub-scanning direction) (in other words, it has a structure which is divided into two parts in the paper feed direction). The absorbing roller modules 42A and 42B have a plurality of absorbing rollers 43 aligned in the main scanning direction which is substantially perpendicular to the paper feed direction. In other words, the absorbing rollers 43 have a structure which is divided into four parts in a direction substantially perpendicular to the paper feed direction.

As shown in FIG. 1, the absorbing roller module 42A on the upstream side in the paper feed direction comprises two absorbing rollers 43A and 43B, and the absorbing roller module 42B on the downstream side in the paper feed direction comprises two absorbing rollers 43C and 43D, similarly. These absorbing rollers 43A to 43D are disposed in a staggered fashion and out of alignment (out of phase) mutually in the sub-scanning direction.

In other words, when the absorbing rollers 43A to 43D are projected so as to be disposed in the main scanning direction, the rollers are disposed in the order, the absorbing roller 43A, the absorbing roller 43C, the absorbing roller 43B and the absorbing roller 43D, sequentially, from the lower side end in FIG. 2; the absorbing roller 43C is disposed in a position where it overlaps partially with the absorbing roller 43A and the absorbing roller 43B; and the absorbing roller 43B is disposed in a position where it overlaps partially with the absorbing roller 43C and absorbing roller 43D.

More specifically, in the solvent removal unit 42, the absorbing roller module 42A and the absorbing roller module 42B are disposed in positions where the absorbing roller modules supplement each other. By using both of these absorbing roller modules 42A and 42B, it is possible to remove solvent from the whole of the printable width of the recording paper 16.

The absorbing roller 43 may be made from a non-woven cloth, hydrophilic porous member, polyvinyl alcohol (PVA), polyurethane-related material, or the like. Instead of the absorbing roller 43, it is also possible to provide a flat plate-shaped absorbing member, or an absorbing member having a wave-shaped or web-shaped surface which makes contact with the solvent.

The absorbing roller module 42A shown in FIG. 1 comprises an elevator mechanism 47A which raises and lowers the absorbing rollers 43A and 43B shown in FIG. 2 independently. The absorbing roller module 42B comprises an elevator mechanism 47B which raises and lowers the absorbing rollers 43C and 43D independently.

By raising and lowering the absorbing rollers 43A to 43D independently by means of the elevator mechanisms 47 (47A and 47B), it is possible to vary the clearances between each of the absorbing rollers 43A to 43D and the print surface of the recording paper 16.

In the present inkjet recording apparatus 10, the absorbing rollers 43A to 43D are made to be in contact with the solvent when the solvent removal is performed, whereas the absorbing rollers 43A to 43D are made to be withdrawn to positions where they do not make contact with the solvent when the solvent removal is not performed. The absorbing rollers 43 are desirably in contact with the solvent on the recording paper 16 when the solvent removal is performed. In order to remove the solvent reliably, it is desirable that the absorbing rollers 43 are pressed against (in contact with) the print surface of the recording paper 16, at a prescribed contact pressure. In order to improve the efficiency of the solvent absorbing, it is possible to reduce the conveyance speed of the recording paper 16.

If the contact pressure is increased, then it is possible to raise the efficiency of the solvent absorbing, however it may raise the possibility of the ink coloring material becoming attached to the surface of the absorbing rollers 43. Hence, the pressure is desirably controlled by varying this contact pressure so that a suitable balance between the solvent absorption efficiency and the possibility of the ink coloring material becoming attached to the solvent absorbing rollers 43 is achieved.

Since the plurality of absorbing rollers 43A to 43D can be independently raised and lowered, then it is possible to carry out the solvent removal by means of each of the absorbing rollers 43A to 43D, individually and separately.

One example of the elevator mechanism 47 has a mechanism which comprises a rail, an eccentric cam, a spring which impels the eccentric cam, and/or the like. The details of the control of the elevator mechanism 47 are described hereinafter.

Although this embodiment shows an example in which the solvent removal unit 42 comprises four independent absorbing rollers 43A to 43D, the number of absorbing rollers 43 may be three or fewer (however, two or more), or it may be five or more. Although the example is shown in which the absorbing rollers 43A to 43D are located in a staggered arrangement, the arrangement of the absorbing rollers 43 is not limited to a staggered configuration. It is also possible to employ an arrangement of the absorbing rollers 43 other than the above-mentioned arrangement, as long as they cover the full width of the printable region.

A heating and pressurizing unit 44 is provided at a stage following the solvent removal unit 42. The heating and pressurizing unit 44 is a device which dries the recording paper 16 and serves to control the luster of the image surface. The heating and pressurizing unit 44 applies pressure to the image surface by means of pressure rollers 45 having prescribed indentation surface (relief-form surface) while the image surface is heated, and thereby an undulating form (relief-form) is transferred to the image surface.

In cases in which printing is performed with dye-based ink on porous paper, blocking the pores of the paper by the application of pressure prevents the ink from coming contact with ozone and other substance that cause dye molecules to break down, and has the effect of increasing the durability of the print.

The printed matter generated in this manner is output from the paper output unit 26. The target print and the test print are preferably output separately. In the inkjet recording apparatus 10, a sorting device (not shown) is provided for switching the outputting pathways in order to sort the printed matter with the target print and the printed matter with the test print, and to send them to paper output units 26A and 26B, respectively. When the target print and the test print are simultaneously formed in parallel on the same large sheet of paper, the test print portion is cut and separated by a cutter (second cutter) 48. The cutter 48 is disposed directly in front of the paper output unit 26, and is used for cutting the test print portion from the target print portion when a test print has been performed in the blank portion of the target print. The structure of the cutter 48 is the same as the first cutter 28 described above, and has a stationary blade 48A and a round blade 48B.

Although not shown in FIG. 1, the paper output unit 26A for the target prints is provided with a sorter for collecting prints according to print orders.

Structure of Head

Next, the structure of the heads 12S, 12K, 12C, 12M, and 12Y is described below. The heads 12S, 12K, 12C, 12M, and 12Y have a common structure, and a reference numeral 50 represents any of the heads hereinafter.

Figure 3A:
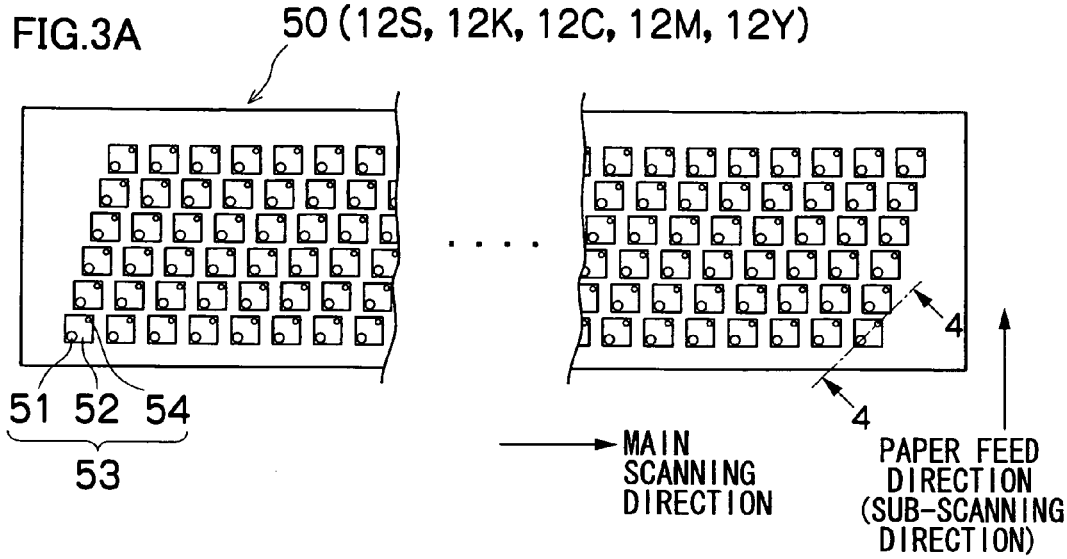
FIGS. 3A to 3C are plan view perspective diagrams showing examples of the composition of a print head.
Figure 3B:
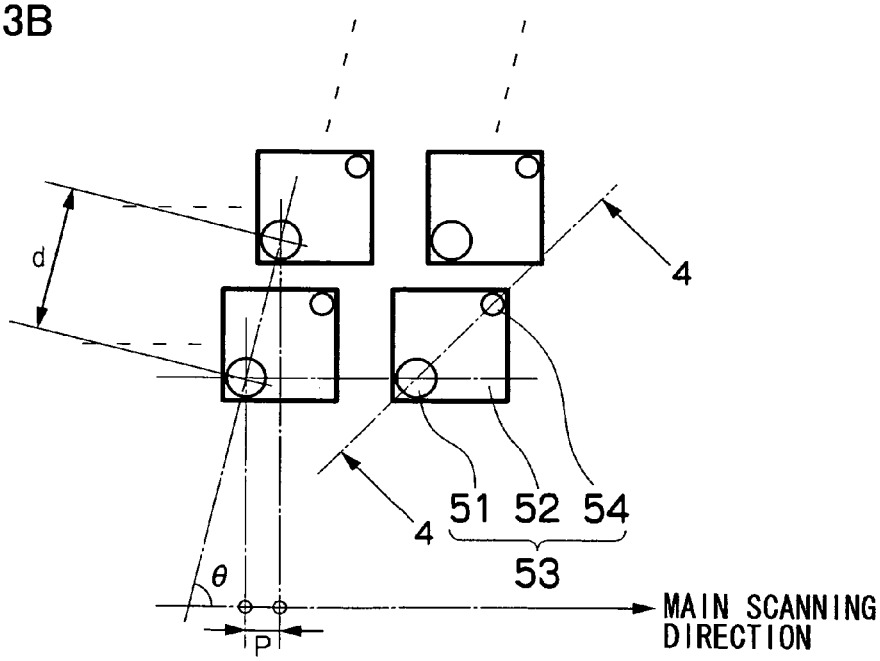
Figure 3C:
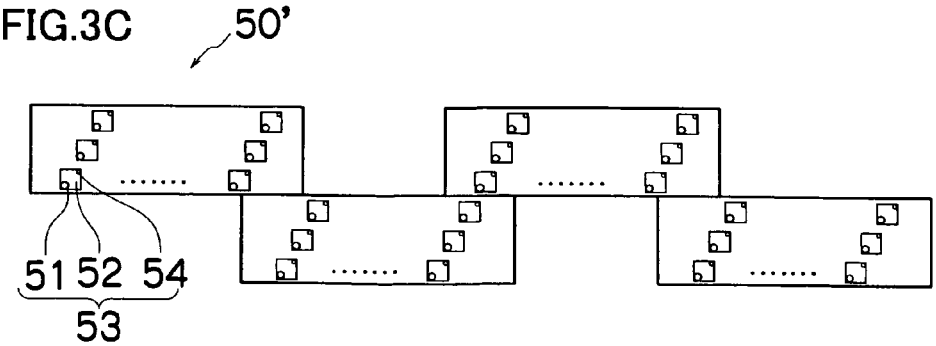
Figure 4:
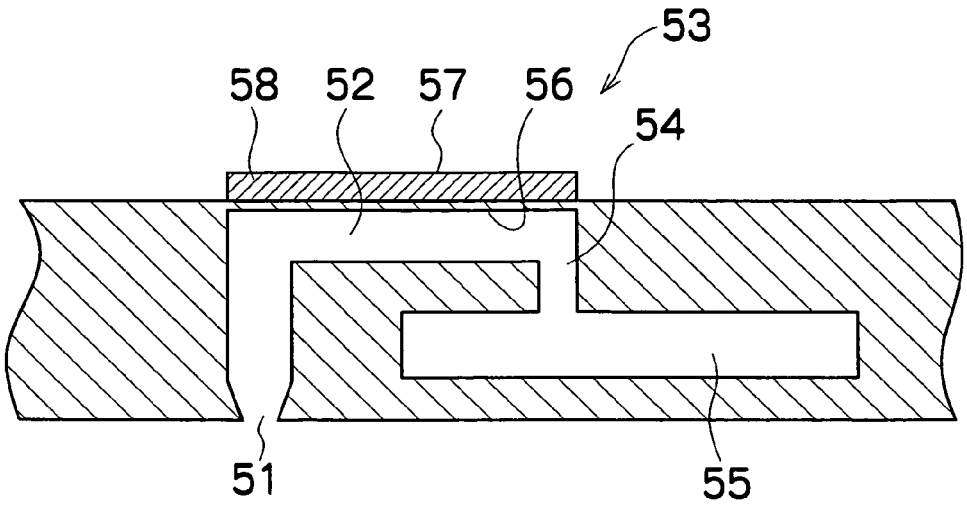
FIG. 4 is a cross-sectional view along line 4-4 in FIGS. 3A and 3B.

FIG. 3A is a plan view perspective diagram showing an example of the structure of the head 50, and FIG. 3B is an enlarged diagram of a portion of the head 50. FIG. 3C is a plan view perspective diagram showing a further example of the composition of the head 50, and FIG. 4 is a cross-sectional diagram showing a three-dimensional composition of an ink chamber unit (a cross-sectional view along line 4-4 in FIGS. 3A and 3B). In order to achieve a high density of the dot pitch printed onto the surface of the recording medium, it is necessary to achieve a high density of the nozzle pitch in the print head 50. As shown in FIGS. 3A to 3C and FIG. 4, the print head 50 in the present embodiment has a structure in which a plurality of ink chamber units 53 including nozzles 51 for ejecting ink droplets and pressure chambers 52 connecting to the nozzles 51 are disposed in the form of a staggered matrix, and the effective nozzle pitch is thereby made small.

More specifically, as shown in FIGS. 3A and 3B, the print head 50 according to the present embodiment is a full-line head having one or more nozzle rows in which a plurality of nozzles 51 for ejecting ink are arranged through a length corresponding to the entire width (printable width) of the recording paper 16 in a direction substantially perpendicular to the paper feed direction.

Moreover, as shown in FIG. 3C, it is also possible to use respective heads 50' of nozzles arranged to a short length in a two-dimensional fashion, and to combine same in a zigzag (staggered) arrangement, whereby a length corresponding to the full width of the recording medium is achieved.

As shown in FIG. 4, the pressure chamber 52 provided corresponding to each of the nozzles 51 is approximately square-shaped in plan view, and a nozzle 51 and a supply port 54 are provided respectively at either corner of a diagonal of the pressure chamber 52. Each pressure chamber 52 is connected via a supply port 54 to a common flow channel 55.

An actuator 58 provided with an individual electrode 57 is bonded to a pressure plate (diaphragm) 56, which forms the upper faces of the pressure chambers 52. When a drive voltage is applied between a common electrode, which is combined with the pressure plate 56, and the individual electrode 57, the actuator 58 deforms, thereby changing the volume of the pressure chamber 52. This causes a pressure change which results in ink being ejected from the nozzle 51. When ink is ejected, new ink is supplied to the pressure chamber 52 from the common flow channel 55 through the supply port 54. A piezoelectric body (piezoelectric element), such as a piezo element, is suitable as the actuator 58. Furthermore, the structure of the ink chamber unit 53 shown in FIG. 4 is merely one embodiment, and it is of course also possible to use another structure.

As shown in FIGS. 3A and 3B, the plurality of ink chamber units 53 having this structure are composed in a lattice arrangement, based on a fixed arrangement pattern aligned in a main scanning direction, which is the lengthwise direction of the print head 50, and an oblique direction which, rather than being perpendicular to the main scanning direction, is inclined at a fixed angle of θ with respect to the main scanning direction. By adopting a structure wherein a plurality of ink chamber units 53 are arranged at a uniform pitch d in a direction having an angle θ with respect to the main scanning direction, the pitch P of the nozzles when projected to an alignment in the main scanning direction will be d×cos θ.

More specifically, the arrangement can be treated equivalently to one in which the respective nozzles 51 are arranged in a linear fashion at a uniform pitch P, in the main scanning direction. By means of this composition, it is possible to achieve a nozzle composition of high density, wherein the nozzle columns projected to an alignment in the main scanning direction reach a total of 2400 per inch (2400 nozzles per inch, or 2400 dpi). Below, in order to facilitate the description, it is supposed that the nozzles 51 are arranged in a linear fashion at a uniform pitch (P), in the main scanning direction.

In implementing the present invention, the arrangement of the nozzles is not limited to that of the embodiment shown. Moreover, a method is employed in the present embodiment where an ink droplet is ejected by means of the deformation of the actuator 58, which is typically a piezoelectric element; however, in implementing the present invention, the method used for discharging ink is not limited in particular, and instead of the piezo jet method, it is also possible to apply various types of methods, such as a thermal jet method where the ink is heated and bubbles are caused to form therein by means of a heat generating body such as a heater, ink being ejected by means of the pressure applied by these bubbles.

Although the present embodiment shows a example in which the treatment liquid ejection head 12S and the print heads 12K, 12C, 12M and 12Y have the same structure (function), the treatment liquid ejection head 12S may have a structure that is different to the print heads 12K, 12C, 12M and 12Y. For example, it is possible to compose the nozzles of the treatment liquid ejection head 12S at a lower nozzle arrangement density than the print heads 12K, 12C, 12M and 12Y (in other words, to increase the nozzle arrangement pitch), and it is also possible to increase the diameter of the nozzles 51 of the treatment liquid ejection head 12S, in conjunction with this. By making the diameter of the nozzles 51 of the treatment liquid ejection head 12S greater than the diameter of the nozzles 51 of the print heads 12K, 12C, 12M, and 12Y, it is possible to achieve compatibility with a treatment liquid having a higher viscosity than the colored inks. In general, the viscosity of the treatment liquid tends to fall when the temperature of the treatment liquid increases, whereas the viscosity of the treatment liquid tends to increase when the temperature falls. For example, if the viscosity of the treatment liquid is adjusted by controlling the temperature of the treatment liquid, then it is possible to control the speed of permeation of the treatment liquid.

Description of Ink Supply System and Treatment Liquid Supply System

Next, the treatment liquid supply system and the ink supply system of the inkjet recording apparatus 10 are described below. In this embodiment, the treatment liquid supply system and the ink supply system have the same composition basically, and are described with reference to the ink supply system shown in FIG. 5 below. The treatment liquid supply system and the ink supply system may be referred to jointly as the "supply system".

Figure 5:
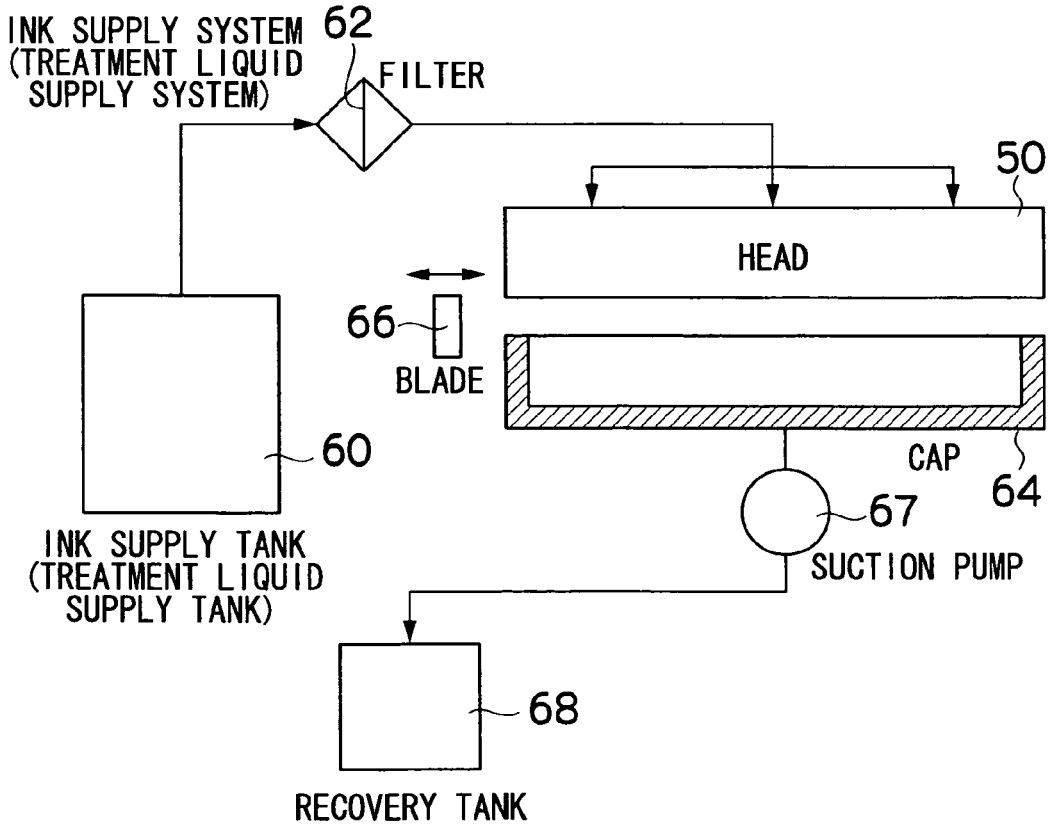
FIG. 5 is a principal block diagram showing the configuration of the supply system of the inkjet recording apparatus shown in FIG. 1.

FIG. 5 shows the composition of the ink supply system provided in the inkjet recording apparatus 10. The ink supply system shown in FIG. 5 corresponds to the storing and loading unit 14 described in FIG. 1.

An ink supply tank (treatment liquid supply tank) 60 forming a base tank for supplying ink (treatment liquid) is disposed in the ink supply system shown in FIG. 5. The ink supply tank 60 may adopt a system for replenishing ink by means of a replenishing opening (not shown), or a cartridge system wherein cartridges are exchanged independently for each tank, whenever the residual amount of ink has become low. If the type of ink is changed in accordance with the type of application, then a cartridge based system is suitable. In this case, desirably, type information relating to the ink is identified by means of a bar code, or the like, and the ejection of the ink is controlled in accordance with the ink type.

Furthermore, the ink in the ink supply tank 60 is supplied to the head 50 after being passed through a filter 62 and prescribed tubing channels (not shown), in order to remove foreign material and air bubbles. The filter mesh size in the filter 62 is preferably equivalent to or less than the diameter of the nozzle and is commonly about 20 μm.

Although not shown in FIG. 5, it is preferable to provide a sub-tank integrally to the head 50 or nearby the head 50. The sub-tank has a damper function for preventing variation in the internal pressure of the head 50 and a function for improving refilling of the head.

The inkjet recording apparatus 10 is also provided with a cap 64 as a device to prevent the nozzles 51 from drying out or to prevent an increase in the viscosity of the ink and the treatment liquid S in the vicinity of the nozzles 51, and a cleaning blade 66 as a device to clean the nozzle face.

A maintenance unit including the cap 64 and the cleaning blade 66 can be relatively moved with respect to the head 50 by a movement mechanism (not shown), and is moved from a predetermined holding position to a maintenance position below the head 50 as required.

The cap is displaced up and down relatively with respect to the head 50 by an elevator mechanism (not shown). When the power of the inkjet recording apparatus 10 is turned OFF or when in a print standby state, the cap 64 is raised to a predetermined elevated position so as to come into close contact with the head 50, and the nozzle face is thereby covered with the cap.

During printing or standby, if the use frequency of a particular nozzle 51 is low and it continues in a state of not ejecting ink or treatment liquid S for a prescribed time period or more, then the solvent of the ink and the solvent of treatment liquid in the vicinity of the nozzle evaporate and consequently the viscosity of the ink and the viscosity of the treatment liquid increase. In a situation of this kind, it would be difficult to eject ink or treatment liquid from the nozzle 51 even if the actuator 58 is operated.

Therefore, before a situation of this kind develops (while the ink or treatment liquid is within a range of viscosity which allows it to be ejected by operation of the actuator 58), the actuator 58 is operated, and a preliminary ejection ("purge", "blank ejection", "liquid ejection" or "dummy ejection") is carried out in the direction of the cap (ink receptacle), in order to expel the degraded ink or degraded treatment liquid (namely, the ink or treatment liquid in the vicinity of the nozzle which has increased in viscosity).

Furthermore, if air bubbles enter into the ink inside the head 50 (inside the pressure chamber 52), then even if the actuator 58 is operated, it will not be possible to eject ink or treatment liquid from the nozzle. In a case of this kind, the cap 64 is placed on the head 50, the ink S (ink and treatment liquid containing air bubbles) inside the pressure chambers 52 is removed by suction, by means of a suction pump 67, and the ink and treatment liquid removed by suction is then supplied to a recovery tank 68.

This suction operation is also carried out in order to remove degraded ink or degraded treatment liquid having increased viscosity (namely, hardened ink or treatment liquid), when ink or treatment liquid is loaded into the print head 50 for the first time, and when the print head starts to be used again after having been out of use for a long period of time. Since the suction operation is carried out with respect to all of the ink and treatment liquid inside the pressure chambers 52, the consumption of the ink and treatment liquid is considerably large. Therefore, desirably, preliminary ejection is carried out while the increase in the viscosity of the ink and treatment liquid is still minor.

The cleaning blade 66 is composed of rubber or another elastic member, and can slide on the ink (treatment liquid) ejection surface (surface of the nozzle plate) of the head 50 by means of a blade movement mechanism (wiper) which is not shown. When ink droplets or foreign matter has adhered to the nozzle plate, the surface of the nozzle plate is wiped and cleaned by sliding the cleaning blade 66 on the nozzle plate. A preliminary discharge is also carried out in order to prevent the foreign matter from becoming mixed inside the nozzles 51 by the blade when the ink ejection surface is cleaned by the blade movement mechanism.

Description of Control System

Figure 6:
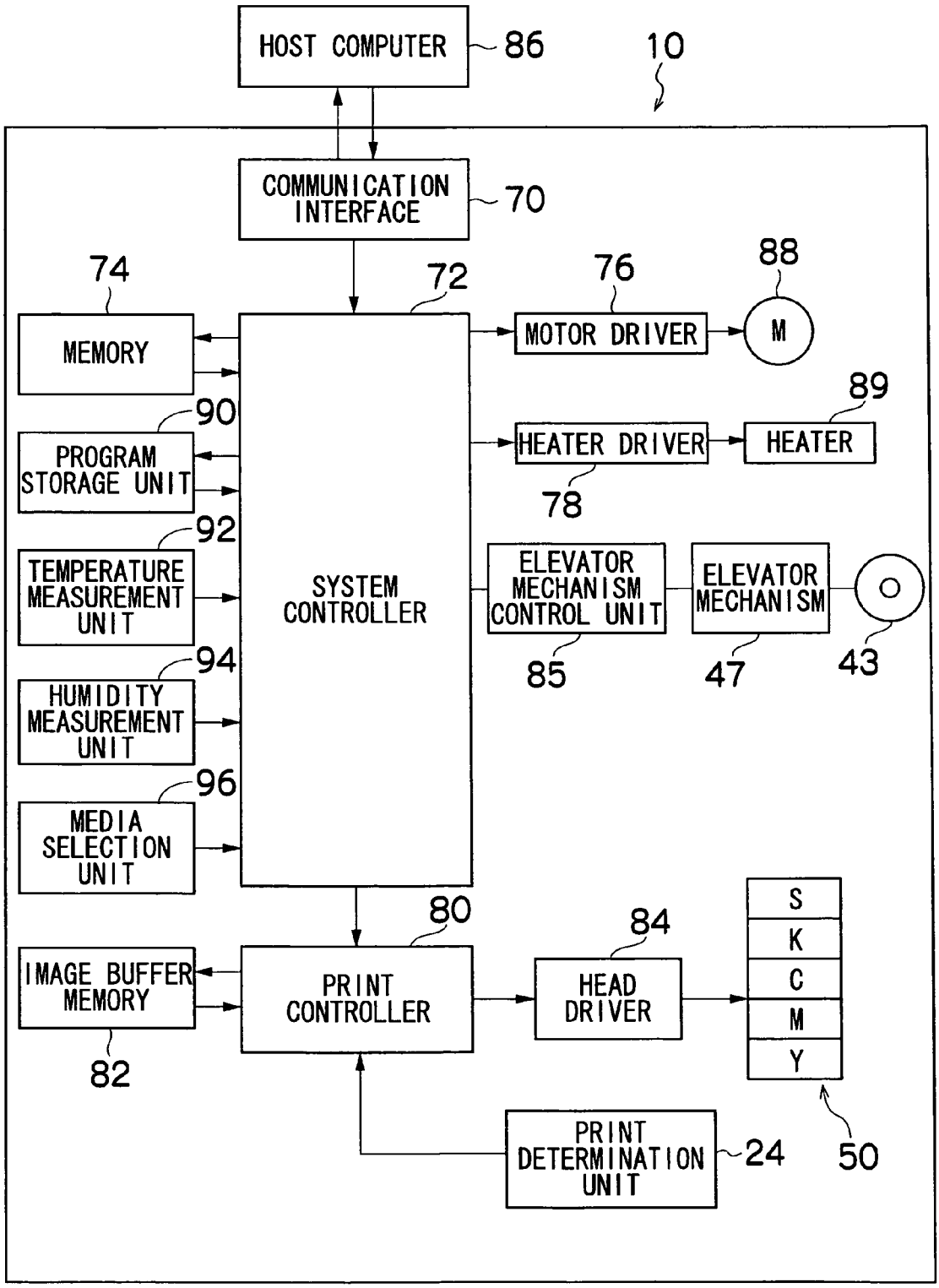
FIG. 6 is a principal block diagram showing the system configuration of the inkjet recording apparatus shown in FIG. 1.

FIG. 6 is a principal block diagram showing the system configuration of the inkjet recording apparatus 10. The inkjet recording apparatus 10 comprises a communication interface 70, a system controller 72, a memory 74, a motor driver 76, a heater driver 78, a print controller 80, an image buffer memory 82, a head driver 84, an elevator mechanism control unit 85, and the like.

The communication interface 70 is an interface unit for receiving image data sent from a host computer 86. A serial interface such as USB, IEEE 1394, Ethernet, wireless network, or a parallel interface such as a Centronics interface may be used as the communication interface 70. A buffer memory (not shown) may be mounted in this portion in order to increase the communication speed. The image data sent from the host computer 86 is received by the inkjet recording apparatus 10 through the communication interface 70, and is temporarily stored in the memory 74.

The memory 74 is a storage device for temporarily storing images input through the communication interface 70, and data is written and read to and from the memory 74 through the system controller 72. The memory 74 is not limited to a memory composed of semiconductor elements, and a hard disk drive or another magnetic medium may be used.

The system controller 72 is constituted by a central processing unit (CPU) and peripheral circuits thereof, and the like, and it functions as a control device for controlling the whole of the inkjet recording apparatus 10 in accordance with a prescribed program, as well as a calculation device for performing various calculations. More specifically, the system controller 72 controls the various sections, such as the communication interface 70, memory 74, motor driver 76, heater driver 78, elevator mechanism control unit 85, and the like, as well as controlling communications with the host computer 86 and writing and reading to and from the memory 74, and it also generates control signals for controlling the motor 88 and heater 89 of the conveyance system.

The motor driver 76 is a driver which drives the motor 88 in accordance with instructions from the system controller 72. The heater driver 78 is a driver which drives the heater 89 used as a temperature adjusting device, or the like, in accordance with instructions from the system controller 72.

The motor 88 shown in FIG. 6 includes a plurality of motors, such as a motor which causes a roller 31 (32) of the suction belt conveyance unit 22 in FIG. 1 to rotate. Furthermore, motor drivers 76 for controlling the plurality of motors 88 are provided to correspond with each of the motors. Of course, it is also possible to integrate a plurality of motor drivers onto a single chip.

The print controller 80 has a signal processing function for performing various tasks, compensations, and other types of processing for generating print control signals from the image data stored in the memory 74 in accordance with commands from the system controller 72 so as to supply the generated print data to the head driver 84. Prescribed signal processing is carried out in the print controller 80, and the ejection amount and the ejection timing of the ink droplets and the treatment liquid from the respective print heads 50 are controlled via the head driver 84.

The print controller 80 is provided with the image buffer memory 82; and image data, parameters, and other data are temporarily stored in the image buffer memory 82 when image data is processed in the print controller 80. The example shown in FIG. 6 is one in which the image buffer memory 82 accompanies the print controller 80; however, the memory 74 may also serve as the image buffer memory 82. Also possible is an example in which the print controller 80 and the system controller 72 are integrated to form a single processor.

The head driver 84 generates a drive signal on the basis of print data supplied by the print controller 80, and drives the actuators of the heads 12S, 12K, 12C, 12M and 12Y, on the basis of this drive signal. A feedback control system for maintaining constant drive conditions in the head may be included in the head driver 84.

Furthermore, an elevator mechanism control unit 85 generates a drive signal on the basis of a common signal supplied by the system controller 72, and drives the elevator mechanisms 47 shown in FIG. 1 and the other drawings, in accordance with this drive signal.

The image data to be printed is input from an external source (the host computer 86, for example) through the communication interface 70, and is stored in the memory 74. In this stage, the RGB image data is stored in the memory 74, for example.

The image data stored in the memory 74 is sent to the print controller 80 through the system controller 72, and is converted to the dot data for each ink color in the print controller 80. In other words, the print controller 80 performs processing for converting the input RGB image data into dot data for four colors, K, C, M, and Y. The dot data generated by the print controller 80 is stored in the image buffer memory 82.

Although the memory 74 is shown as a storage unit attached to the system controller 72 in the present embodiment, the memory 74 may also be constituted by a plurality of memories (storage media). Furthermore, it is also possible to incorporate the memory into the system controller 72. The information stored in the memory 74 may include, in addition to the RGB image data described above, various setting information, system parameters, a threshold value table used to determine conditions, various types of data tables, correction-coefficients used for various corrections, and the like.

Various control programs are stored in a program storage section 90, and a control program is read out and executed in accordance with commands from the system controller 72. The program storage section 90 may use a semiconductor memory, such as a ROM, EEPROM, or a magnetic disk, or the like. An external interface may be provided, and a memory card or PC card may also be used. Naturally, a plurality of these storage media may also be provided.

The program storage unit 90 may also be used as a recording device (memory) (not shown) for storing operational parameters (system parameters), and the like.

The print determination unit 24 is a block that includes the line sensor as described above with reference to FIG. 1. The print determination unit 24 can read the image printed on the recording paper 16; determine the ejection conditions (presence of the ejection, variation in the dot formation, and the like) by performing desired signal processing, or the like; and provide the determination results of the print conditions to the print controller 80.

The print controller 80 makes various corrections with respect to the head 50 on the basis of information obtained from the print determination unit 24, according to need.

The inkjet recording apparatus 10 comprises a temperature measurement unit 92 and a humidity measurement unit 94. The temperature measurement unit 92 and the humidity measurement unit 94 measure the ambient temperature and the ambient humidity of the head 50 and the recording paper 16 placed in the print region, respectively. A temperature signal which indicates the temperature (temperature information) measured by the temperature measurement unit 92, and a humidity signal indicating the humidity (humidity information) measured by the humidity measurement unit 94, are sent to the system controller 72. The system controller 72 controls a temperature changeable device, such as a heater 89, cooling fan (not shown), and the like, on the basis of this temperature signal and humidity signal in such a manner that a prescribed temperature and humidity (a set temperature and humidity) are maintained.

Furthermore, the present inkjet recording apparatus 10 comprises a media selection unit 96 for selecting the type of recording paper (media) used, and implements various types of control, such as a control of the ejection of treatment liquid and ink, temperature and humidity control of the head 50, and the like, in accordance with the type of media selected by the media selection unit 96.

More specifically, when the media type information selected by the media selection unit 96 is sent to the system controller 72, then the system controller 72 determines the type of the media according to the media type information, and controls the various sections of the apparatus in accordance with the type of media.

The mode of selecting the type of media by means of the media selection unit 96 may involve the operator inputting a desired media type by means of a man-machine interface, such as a keyboard, touch panel, or the like. Alternatively, the type of media may be directly determined by means of a determination device, such as the print determination unit 24. Moreover, it is also possible to automatically determine the type of paper used, by reading in, by means of a prescribed reading apparatus, information on an information recording body on which the information of the paper type is recorded. The information recording body, such as a barcode and wireless tag, may be attached to a magazine or tray holding the recording paper 16.

Description of Maintenance of Solvent Removal Unit

Next, the maintenance of the solvent removal unit 42 shown in FIGS. 1 and 2 is described below.

Figure 7:
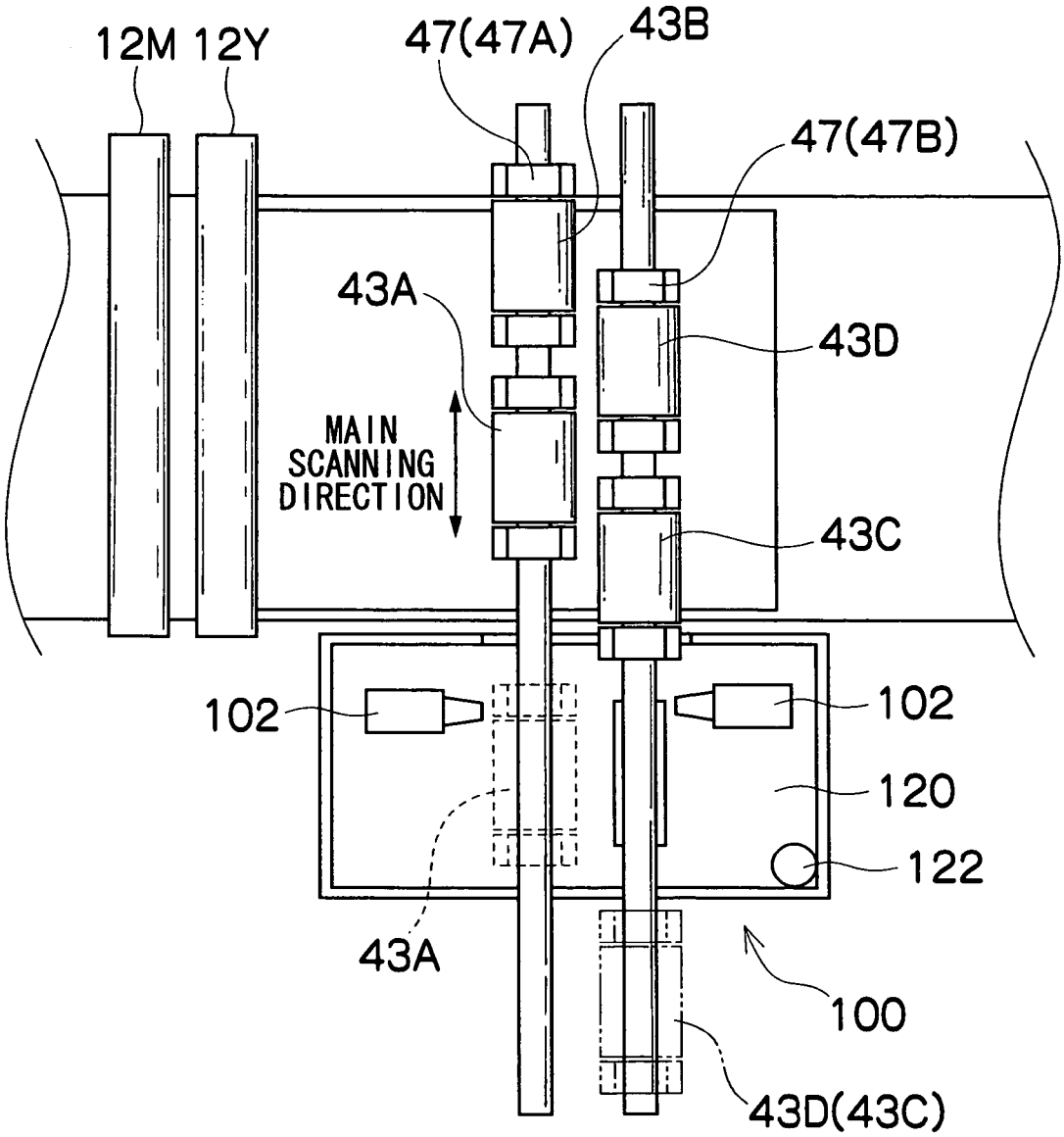
FIG. 7 is a plan diagram showing the general composition of a maintenance mechanism of the solvent removal unit shown in FIG. 1.
Figure 8:
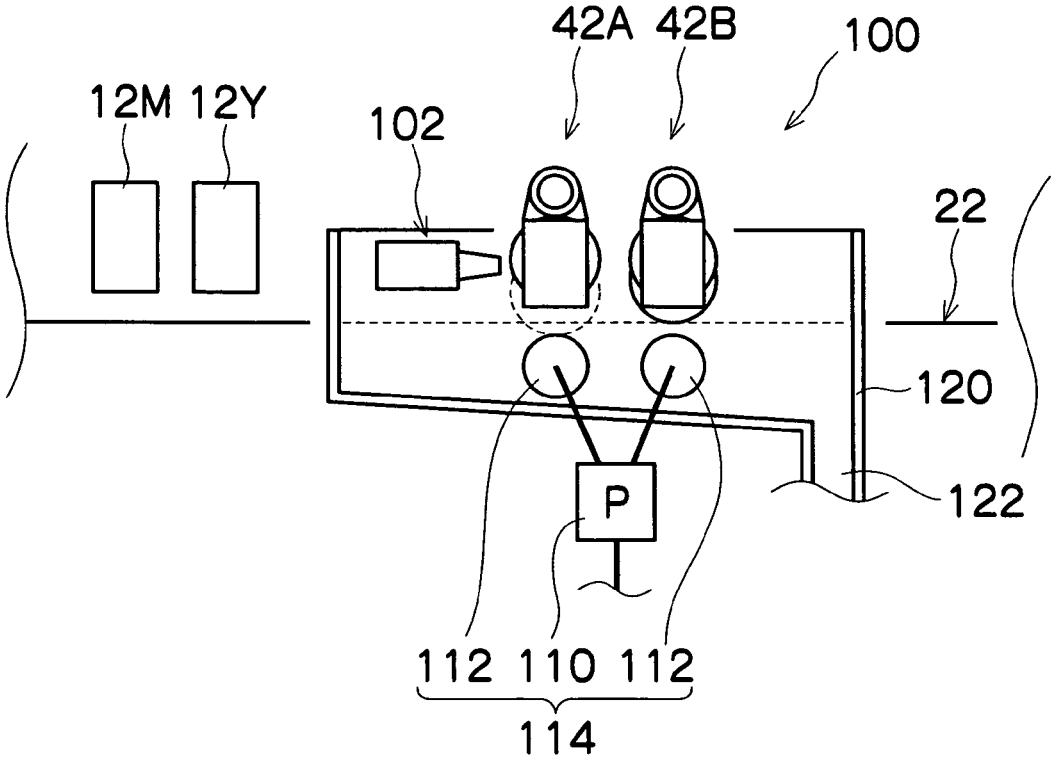
FIG. 8 is a side view of a maintenance unit shown in FIG. 7.

FIG. 7 is a plan diagram showing the principal composition of the maintenance station 100 (a diagram corresponding to FIG. 2 in which the head 50 is viewed from the upper side). FIG. 8 is a diagram of same viewed from the side face (a diagram corresponding to FIG. 1).

As shown in FIGS. 7 and 8, the maintenance station 100 includes: a cleaning liquid ejection unit (cleaning unit) 102, provided to the side of the suction belt conveyance unit 22 (in a non-printing position), which cleans the absorbing rollers 43 by ejecting cleaning liquid onto the absorbing rollers 43 after removal of solvent; a solvent recovery unit 114 (not shown in FIG. 7), having recovery rollers 112 (not shown in FIG. 7) coupled to a suction pump 110 (not shown in FIG. 7), the solvent recovery unit 114 gathering solvent absorbed by the absorbing rollers 43; and a tray 120 which receives cleaning liquid, and soiling, and the like, removed from the absorbing rollers 43. The tubing channel (drain) indicated by reference numeral 122 is connected to a solvent disposal tank (for example, the recovery tank 68 shown in FIG. 5), in which the liquid and soiling collected in the tray 120 is accumulated.

As shown in FIG. 7, the absorbing rollers 43 have a structure where the absorbing rollers 43 are independently movable in the main scanning direction (the direction of the arrow in the FIG. 7). The absorbing rollers 43 are moved to a withdrawal position where the aforementioned maintenance station 100 is provided, after carrying out solvent removal from the recording paper 16.

In this embodiment, the mechanisms which move the absorbing rollers 43 independently in the sub-scanning direction have the structure where the absorbing rollers 43 and the elevator mechanisms 47 are moved integrally. This movement mechanism includes: a carriage which holds the absorbing rollers 43 and the elevator mechanism 47 integrally; a mechanism, such as a belt drive mechanism or the like, for moving the carriage; and a motor (actuator) or the like, which forms a drive source for this mechanism. The movement mechanism operates in accordance with a drive signal supplied by the control system shown in FIG. 6.

When the absorbing rollers 43 arrive at the withdrawal position, a cleaning liquid, such as pure water, is applied to the absorbing rollers 43 from a cleaning liquid ejection unit, thereby removing soiling from the surface and interior of the absorbing rollers 43. FIG. 7 shows a state where absorbing roller 43C is being cleaned in the withdrawal position.

Thereafter, the recovery rollers 112 abut against the absorbing rollers 43, and the surplus solvent absorbed by the absorbing rollers 43 is removed. The recovery rollers 112 are made of a material, such as a porous material or polymer having higher absorptivity than the absorbing rollers 43.

The surplus solvent collected in the recovery rollers 112 is sent to the solvent disposal tank via a suction pump 110. In retrieving the solvent from the absorbing rollers 43, it is also possible to generate a negative pressure by means of a suction pump 110 in such a manner that the solvent is suctioned and removed from the absorbing rollers 43.

When the solvent removal is not performed, the absorbing rollers 43 are controlled in such a manner that they can be maintained periodically. Furthermore, a composition may be adopted in which the number of maintenance operations (or the period of maintenance time) of the absorbing rollers 43 is stored in the memory 74 (shown in FIG. 6), or the like. If the number of maintenance operations (or the time period of maintenance time) exceeds a prescribed value, then a report is issued indicating that replacement of the absorbing rollers 43 is due. The reporting device may issue a voice or warning sound, or it may display text-based information on a display device such as a monitor. Furthermore, it may also issue a report based on a warning lamp, or the like.

Although omitted from the drawings, in order to prevent adherence of coloring material to the absorbing rollers 43, it is possible to provide a roller for the ink coloring material in the stage before the solvent removal unit 42 (on the upstream side in terms of the paper feed direction). The roller for the ink coloring material may be made of a different material to the absorbing rollers 43 and be designed with particular attention to fixing the ink coloring material.

Furthermore, it is also possible to provide a subsidiary solvent removal unit which has an absorbing roller of lower absorption force than that of the absorbing rollers 43 and/or pores having different sizes, in a stage before the solvent removal unit 42, in such a manner that the absorption force can be adjusted. The absorption force may also be adjusted by altering the contact pressure between the absorbing rollers 43 and the recording paper 16.

Although the present embodiment describes an example in which the force of a suction pump 110 (namely, an external force) is used as the solvent absorption force of the solvent removal unit 42, it is also possible to use the capillary action of a porous member. The solvent removal unit 42 has a structure where the speed of absorption due to the solvent absorption force is faster than the speed of permeation at which the solvent permeates into the recording paper 16.

Description of Solvent Removal

Next, the solvent removal carried out by using the solvent removal unit 42 shown in FIG. 1 is described in detail. In the solvent removal shown in the present embodiment, the solvent removal unit 42 is controlled on the basis of the time period until removal of the solvent (the time period until completion of solvent removal), the ejection volumes (droplet ejection volumes) of the ink and the treatment liquid, and the type of recording paper 16 (media type). Furthermore, the droplet ejection conditions, such as the conveyance speed, droplet ejection frequency, and the like, are controlled on the basis of these various conditions. The "solvent volume" referred to here indicates the sum total of the volume of solvent in the ink and the volume of solvent in the treatment liquid. Since the ratio of the coloring material in the ink is approximately several percents and the ratio of solute in the treatment liquid is also approximately several percents, then it may not be inconvenient to take the solvent volume as the combined total of the ink volume and the treatment liquid volume.

More specifically, a threshold value (solvent volume threshold value) for the ink volume and the treatment liquid volume, and a threshold value (permeation time threshold value) until the solvent is removed, are set, and then the solvent removal performed by the solvent removal unit, the droplet ejection volumes of the ink and treatment liquid, the droplet ejection frequency, and the conveyance speed of the recording paper 16 (suction belt conveyance unit 22), are controlled according to the combination of these two threshold values.

Cockling occurs because the hydrogen bonds inside the recording paper 16 are caused to be broken down when the solvents (principally water) in the ink and treatment liquid permeates into the recording paper 16. Accordingly, the cockling is dependent on the permeation amount of and the permeation speed of the solvent permeating into the paper. Hence, the time period until cockling occurs varies depending on the type of recording paper 16 and the surface characteristics (surface treatment) thereof. The cockling tolerance level varies depending on the intended end-usage of the image, and should not be determined simply on the basis of the level of undulation of the surface of the recording paper 16. Hence, the cockling tolerance level is also determined from the viewpoint of image quality. In the present embodiment, the tolerability of the cockling is determined in terms of the image quality that indicates whether the wrinkles are acceptable or not, and in terms of the conveyance performance that indicates whether the head does not make contact with the medium.

Figure 9:
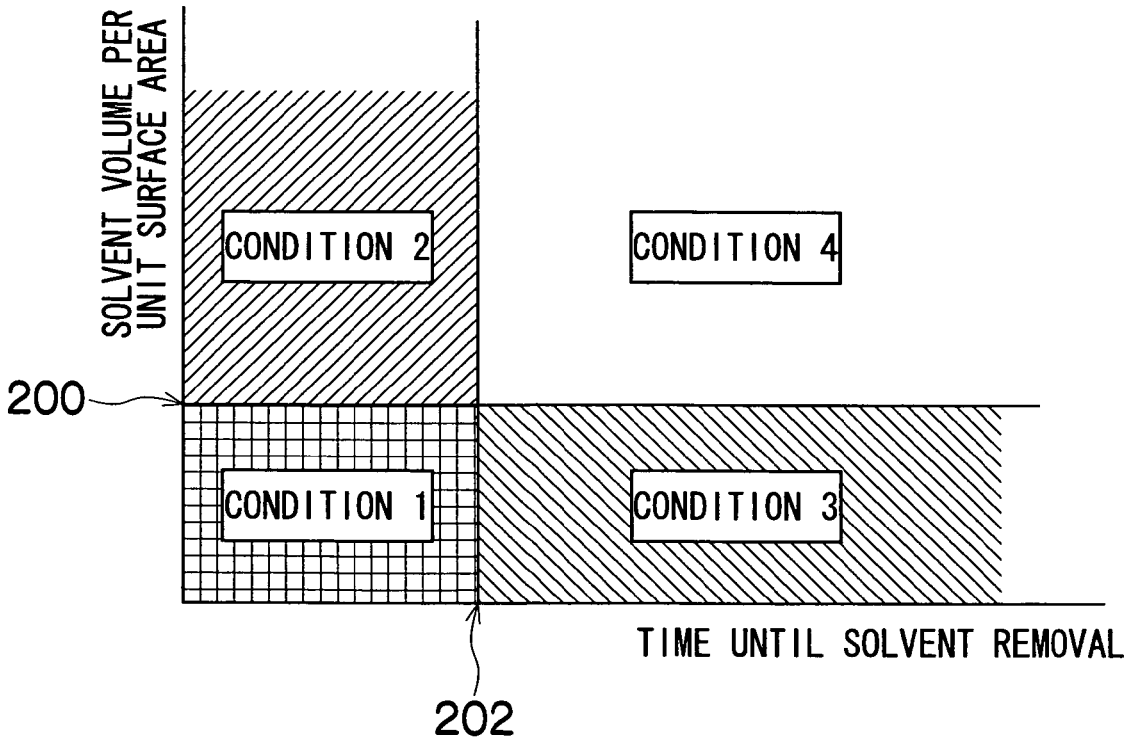
FIG. 9 is a diagram illustrating a solvent volume threshold value and a permeation time threshold value.

From this viewpoint, the solvent volume threshold value 200 (liquid volume threshold value) and the permeation time threshold value (liquid removal time threshold value) are set as shown in FIG. 9. In this embodiment, a delayed-permeation type of ink which has a slower permeation time than a general ink is used.

In FIG. 9, the vertical axis indicates the solvent volume per unit surface area, and the horizontal axis indicates the time until the completion of solvent removal (namely, the time period until removal of the solvent, that is, a time period determined on the basis of the distance between the ink ejection position in the conveyance path of the recording paper 16 and the solvent removal unit 42, the distance between the treatment liquid ejection position in the conveyance path of the recording paper 16 and the solvent removal unit 42, and the conveyance speed of the recording paper 16). In FIG. 9, the solvent volume indicated by reference numeral 200 is the solvent volume threshold value, and the time period indicated by the reference numeral 202 is the permeation time threshold value. The solvent volume threshold value 200 shown in FIG. 9 indicates the solvent volume at which an unacceptable level of cockling occurs on the recording paper 16 if the solvent volume permeating into the recording paper 16 exceeds this solvent volume threshold value 200. The permeation time threshold value 202 indicates the time period at which an unacceptable level of cockling occurs on the recording paper 16 if the permeation time period after the ink and treatment liquid landing onto the recording paper 16 exceeds this permeation time threshold value 202. These values can be determined according to the permeation speed of the solvent into the recording paper 16.

Cockling may occur on the recording paper 16 even if the permeation time period from the ink and treatment liquid landing onto the recording paper 16 does not exceed this permeation time threshold value 202; however, such cockling that arises within a time range that does not exceed the permeation time 202 would be acceptable from the viewpoint of the quality of the recorded image. In the present embodiment, attention is given to cockling which arises after a time exceeding the permeation time threshold value 202 from the landing of the ink and treatment liquid on the recording paper 16, and which cannot be tolerated from the viewpoint of image quality (and/or cannot be tolerated from the viewpoint of conveyance speed).

In other words, in Condition 1 shown in FIG. 9, the solvent volume per unit surface area is equal to or less than the solvent volume threshold value 200, and hence satisfies conditions where unacceptable cockling does not occur on the recording paper 16. More specifically, since unacceptable cockling does not occur (in other words, cockling does not occur at all, or the level of cockling occurring is an acceptable), even if all of the solvent in the ink and treatment liquid ejected as droplets onto the recording paper 16 permeates into the recording paper 16, then the solvent removal is not necessary in cases where Condition 1 is satisfied. Accordingly, the solvent removal unit 42 is switched off, and the absorbing rollers 43A to 43D are withdrawn to a position where they do not make contact with the recording paper 16 (and/or with the ink and treatment liquid on the recording paper 16).

In Condition 2, since the solvent volume per unit surface area exceeds the solvent volume threshold value 200, then solvent removal is carried out. In other words, the solvent removal unit 42 is switched on, and the absorbing rollers 43A to 43D are placed in contact with the recording paper 16 (and/or with the ink and treatment liquid on the recording paper 16). In Condition 2, solvent removal is carried out within a time period that does not exceed the permeation time threshold value 202 (namely, before the permeation of solvent is finished). Hence, it satisfies conditions under which cockling does not occur. Furthermore, in Condition 3, the solvent volume per unit surface area is equal to or less than the solvent volume threshold value 200, and the solvent removal is not required because it satisfies conditions under which unacceptable cockling does not occur on the recording paper 16, similarly to Condition 1.

On the other hand, in Condition 4, since the solvent volume per unit surface area exceeds the solvent volume threshold value 200, then it is necessary to perform the solvent removal. However, since the time period until solvent removal exceeds the permeation time threshold value 202, then unacceptable cockling can occur on the recording paper 16. Hence, in the case of Condition 4, rather than implementing normal printing, the print conditions (conveyance speed of recording paper 16, ink and treatment liquid ejection volumes, ejection frequency, and/or the like) are changed, and a prescribed printing operation is carried out in such a manner that one of Conditions 1 to 3 is satisfied.

In this inkjet recording apparatus 10, if it is determined that Condition 4 applies, then the droplet ejection volumes for the ink and the treatment liquid are reduced and controlled in such a manner that the solvent volume per unit surface area becomes equal to or lower than the solvent volume threshold value 200. In other words, the droplet ejection volumes of the ink and the treatment liquid are controlled in such a manner that the conditions of the print in question changes from Condition 4 to Condition 3.

Furthermore, in the case of a print corresponding to Condition 4, it is also possible to implement control in such a manner that solvent removal is completed within the permeation time threshold value 202. In other words, in the case of a print corresponding to Condition 4, the suction belt conveyance unit 22 is controlled in such a manner that the linear speed (conveyance speed) of the suction belt conveyance unit 22 is raised, and the condition of the print in question changes from Condition 4 to Condition 2.

FIG. 10 shows one example of the solvent volume threshold value 200 and the permeation time threshold value 202. As shown in FIG. 10, in the case of PPC paper (normal paper), the solvent volume threshold value 200 is 8 $ml/m^2$ and the permeation time threshold value 202 is 1 sec. Furthermore, in the case of art paper or coated paper, the solvent volume threshold value 200 is 5 $ml/m^2$ and the permeation time threshold value 202 is 5 sec, and in the case of copy paper, the solvent volume threshold value 200 is 25 $ml/m^2$ and the permeation time threshold value 202 is 10 sec.

In the case of an OHP sheet, the solvent volume threshold value is zero. Since solvent does not permeate into an OHP sheet, cockling does not occur, and the solvent removal is always carried out when there is the solvent present on an OHP sheet. Furthermore, since the solvent does not permeate into an OHP sheet, there is no restriction on the time period until the removal of the solvent and the permeation time threshold value is infinity.

Moreover, it is desirable that the solvent volume threshold value and the permeation time threshold value are changed in accordance with the ambient conditions, such as the temperature, humidity, and the like, because this allows the solvent removal to be controlled suitably in accordance with the ambient conditions. For example, since the viscosity of the ink and the treatment liquid falls when the temperature rises, then it is necessary to lower the permeation time threshold value, whereas when the temperature falls, then the viscosities of the ink and the treatment liquid rise, and therefore the permeation time threshold value can be increased.

Control of Solvent Removal

Figure 11:
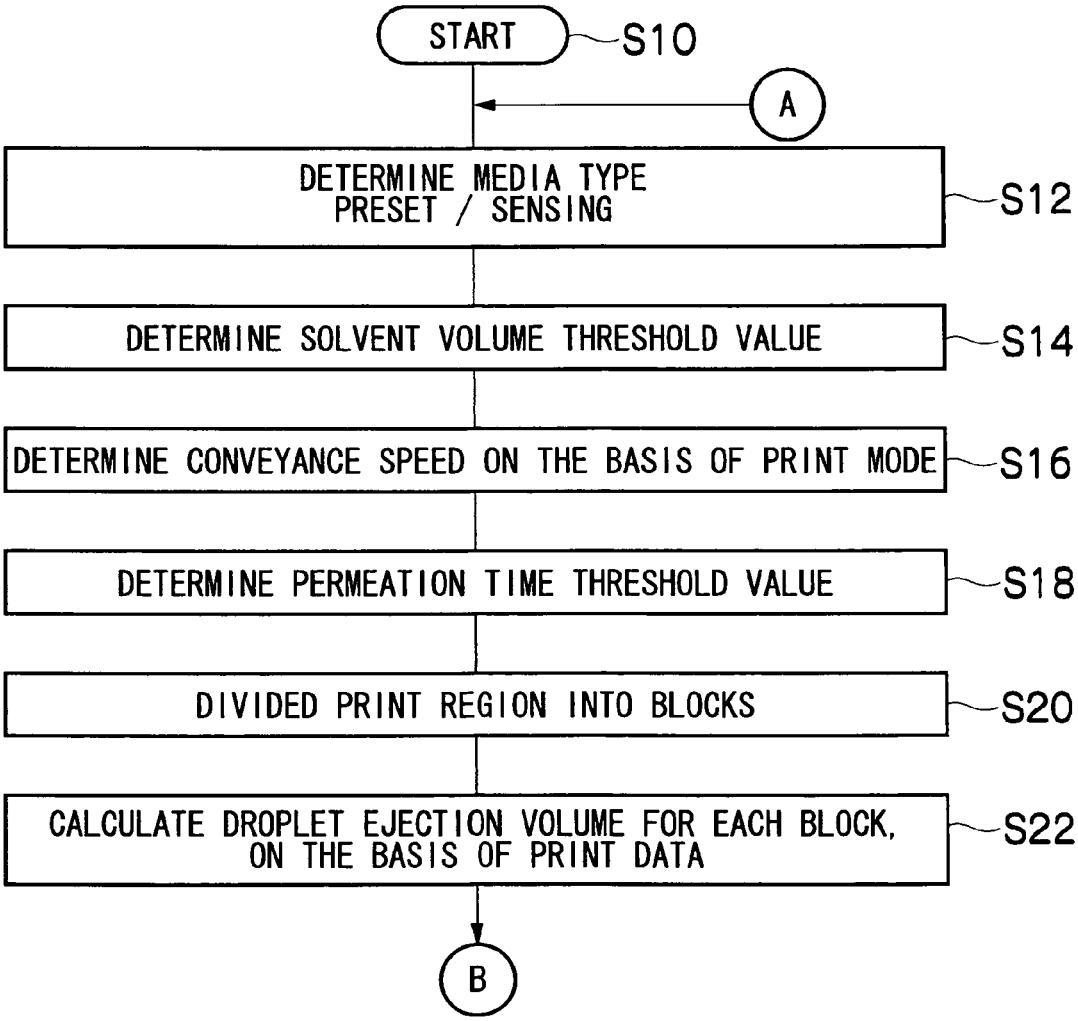
FIG. 11 is a flowchart showing a sequence of solvent removal control according to the embodiment of the present invention.
Figure 12:
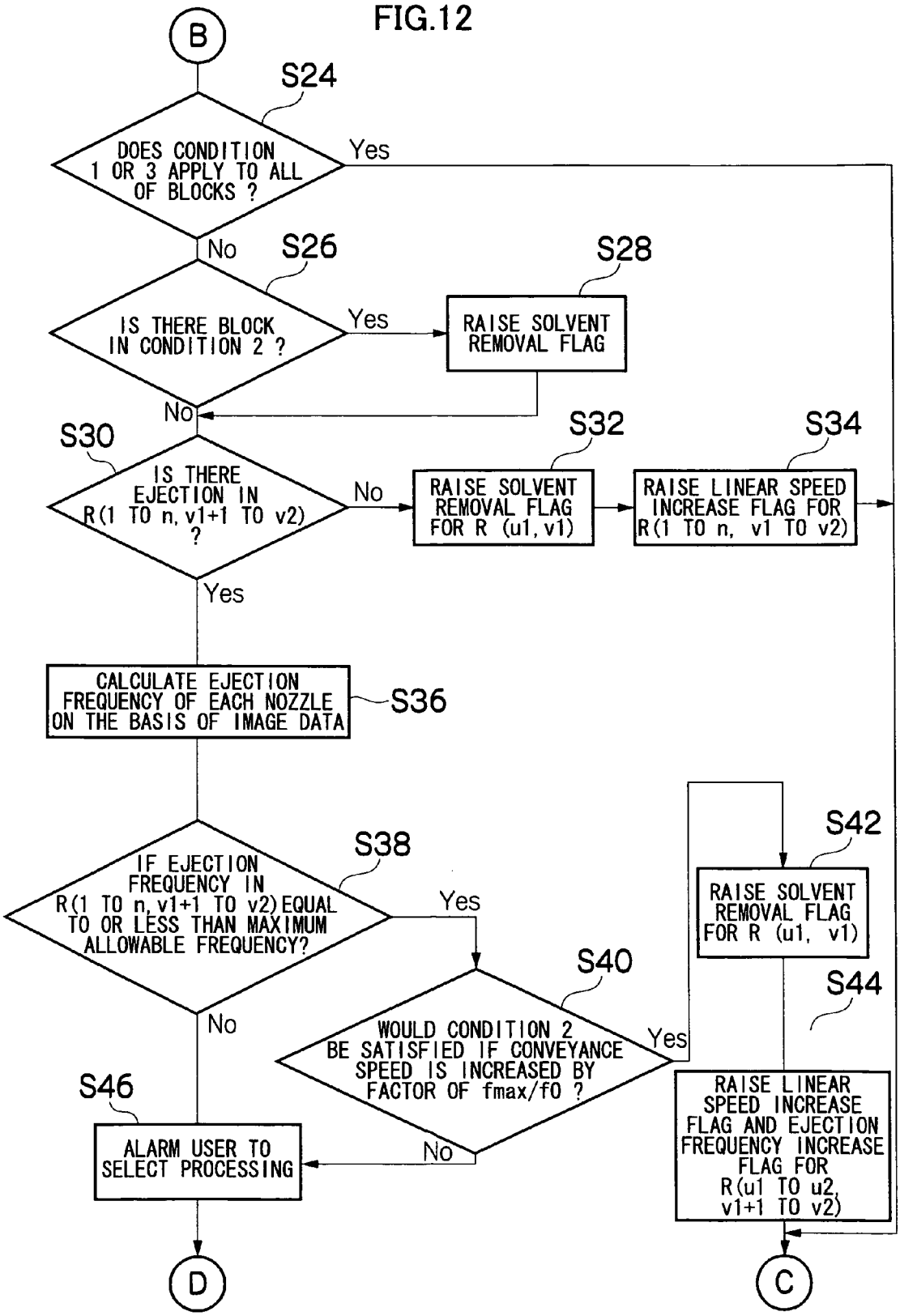
FIG. 12 is a flowchart showing a sequence of solvent removal control according to the embodiment of the present invention.
Figure 13:
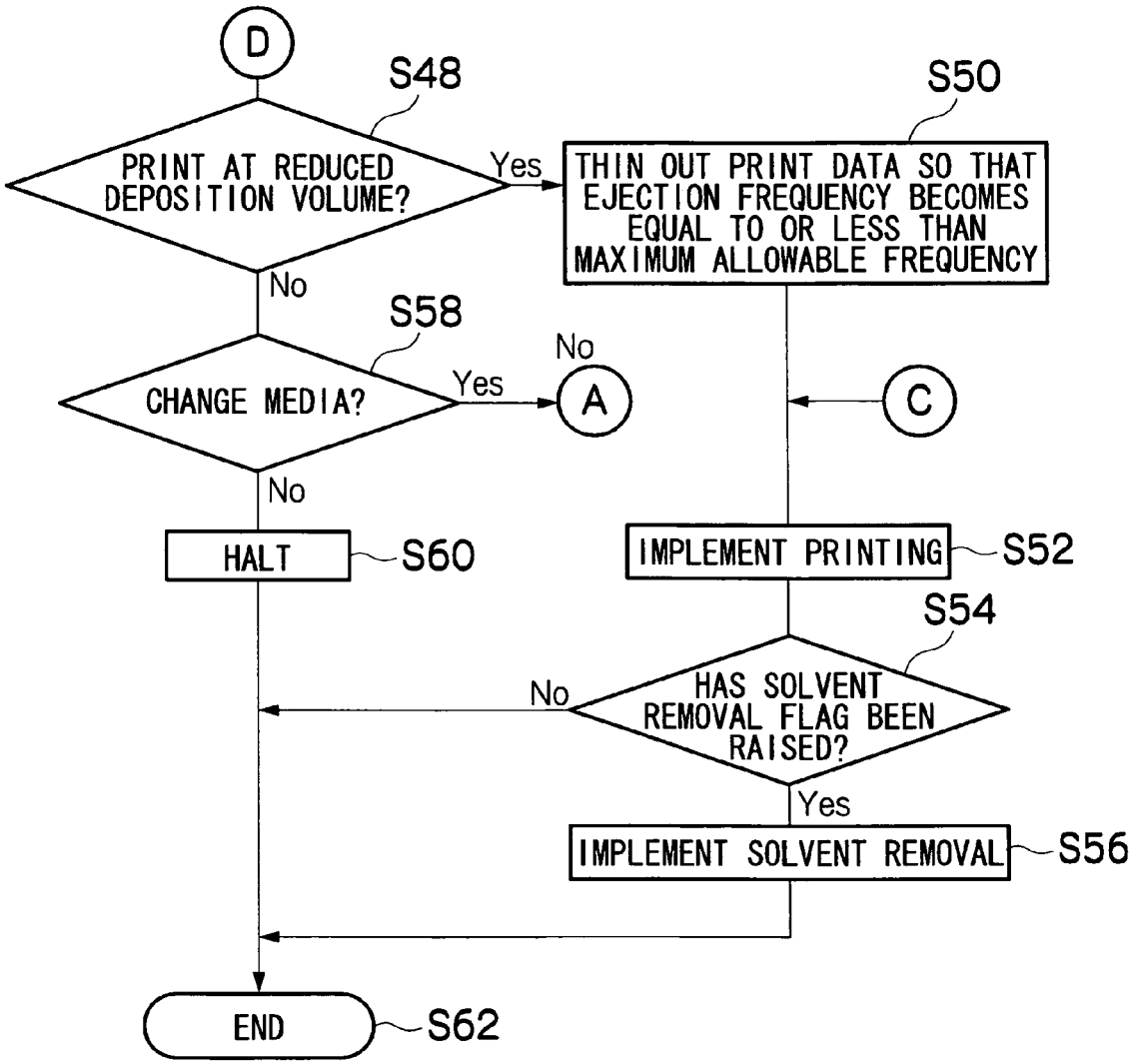
FIG. 13 is a flowchart showing a sequence of solvent removal control according to the embodiment of the present invention.
Figure 14:
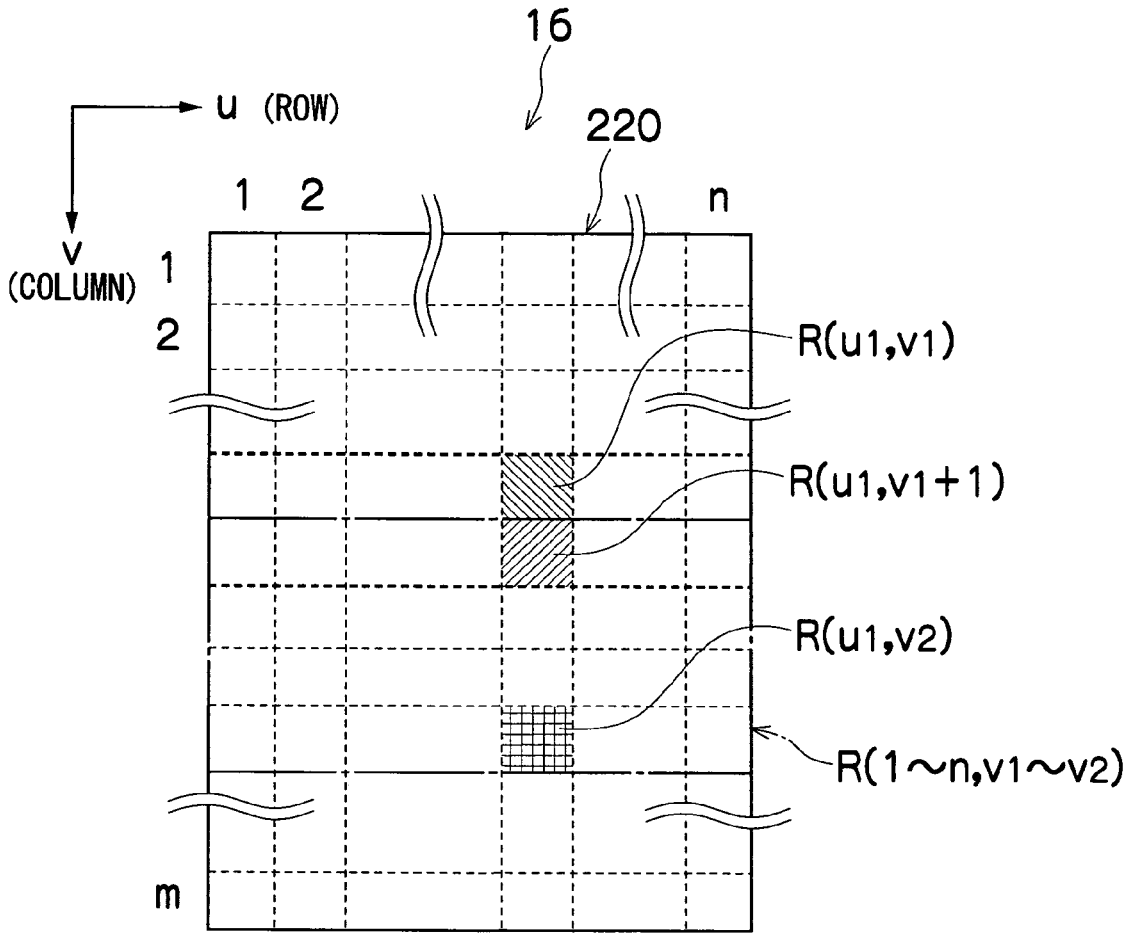
FIG. 14 is a diagram showing one example of a block dividing method.

FIGS. 11 to 13 are flowcharts showing the sequence of the solvent removal control in a print control procedure according to the present embodiment. As shown in FIG. 14, in the solvent removal control according to this embodiment, the recording paper 16 is divided into a plurality of blocks (a plurality of blocks are established), and then it is determined which of the conditions shown in FIG. 9 applies to each of the blocks, and the solvent removal is implemented in accordance with the conditions of the blocks.

As shown in FIG. 11, when print control starts and print data is acquired (step S10), preset processing and sensing processing for determining (selecting or setting) the type of recording paper 16 (media type) are carried out (step S12), and the procedure then advances to step S14.

At the step S14, the solvent volume threshold value 200 shown in FIG. 9 is determined on the basis of the recording paper information (media type information) corresponding to the type of recording paper 16 determined at step S12.

Moreover, at step S16, the conveyance speed of the recording paper 16 (the linear speed of the belt suction conveyance unit 22 shown in FIG. 1) is determined according to the established print mode, and the permeation time threshold value 202 shown in FIG. 9 is determined on the basis of the type of the recording paper 16 and the conveyance speed of the recording paper 16 (step S18).

The relationship between the solvent volume threshold value and the type of recording paper 16 (and the type of solvent), and the relationship between the type of recording paper 16 and the conveyance speed of the recording paper 16 and the permeation time threshold value, are previously recorded in the form of a data table, which is stored in a storage medium (storage unit), such as a memory 74 shown in FIG. 6. When the solvent volume threshold value 200 and the permeation time threshold value are determined as described above, it is also possible to refer to information on the types of the ink and the treatment liquid, and ambient conditions such as the temperature and humidity.

When the solvent volume threshold value 200 and the permeation time threshold value 202 have been determined in this way, then the print region 220 of the recording paper 16 (shown in FIG. 14) is divided into a plurality of blocks (step S20), and the treatment liquid droplet ejection volume and the ink droplet ejection volume are calculated for each of the blocks, on the basis of the print data (step S22).

FIG. 14 shows one example in which the print region 220 of the recording paper 16 is divided into a plurality of blocks. In the example shown in FIG. 14, the print region 220 is divided into n regions in the row (u) direction (the direction substantially perpendicular to the paper feed direction), and m regions in the column (v) direction (paper feed direction), thereby creating n×m blocks (in other words, a mesh of n×m blocks is established in the print region). In FIG. 14, each block is expressed as R (u, v), where u is an integer between 1 and n, and v is an integer between 1 and m.

When the droplet ejection volumes for each block have been calculated at step S22, then the procedure advances to step S24 in FIG. 12. At step S24, it is determined whether each block satisfies Condition 1 or Condition 3 in FIG. 9 or not. If it is determined that all of the blocks satisfy Condition 1 or Condition 3 (YES judgment), then the procedure advances to step S52 in FIG. 13, and a prescribed printing operation is carried out.

On the other hand, if it is determined at step S24 in FIG. 12 that there is a block to which Condition 2 or Condition 4 applies (NO judgment), then the procedure advances to step S26, where it is determined whether there is a block to which Condition 2 applies (if any of the blocks satisfies Condition 2) or not.

A solvent removal flag is made to be on for any block determined at step S26 to satisfy Condition 2 (step S28), and the procedure then advances to step S30. Concerning the block(s) is determined to satisfy Condition 4 at step S26 (NO judgment), the procedure advances to step S30 where it is determined whether the ejection is to be performed in the region in question or not.

If the block R (u1, v1) in FIG. 14 is determined to satisfy the Condition 4, then at step S30, the presence or absence of ejection in the region in question is determined by examining the print data with respect to the plurality of blocks which are included in the range of R (1 to n, v1+1 to v2) (in FIG. 14, a region spanning the whole row direction and including the region adjacent to the block R (u1, v1) in the column direction, as indicated by the single-dotted lines). If there is no print data concerning the blocks included in this range of R (1 to n, v1+1), then a solvent removal flag is made to be on for the block R (u1, v1) (step S32) and a linear speed increase flag is made to be on for the blocks contained in the range of R (1 to n, v1 to v2) (step S34), whereupon the procedure advances to the implementation of printing in step S52.

Figure 15:
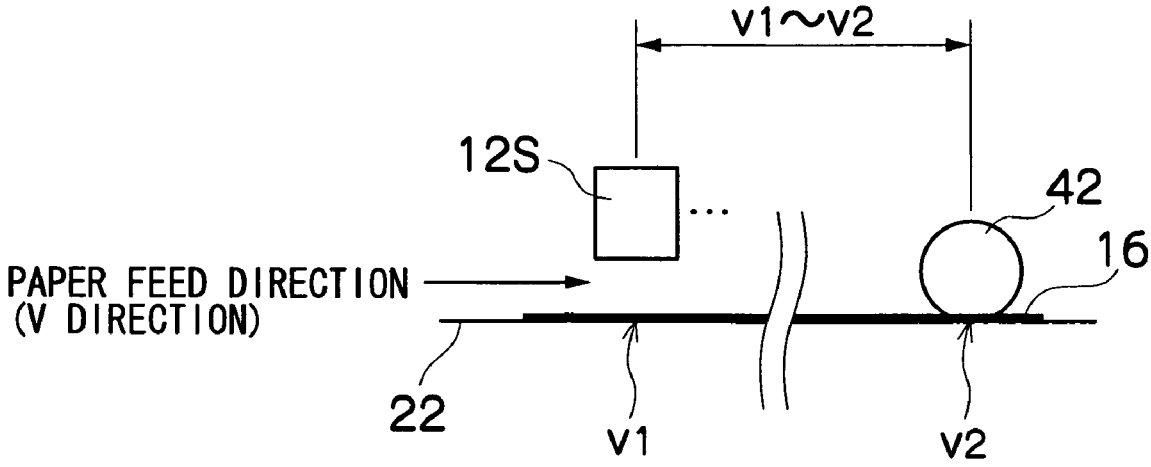
FIG. 15 is a diagram showing the positional relationships in the v direction shown in FIG. 14.

As shown in FIG. 15, v1 and v2 respectively indicate a position (coordinate) in the paper feed direction corresponding to the treatment liquid ejection head 12S (the head on the furthest upstream side in the paper feed direction), and a position in the paper feed direction corresponding to the solvent removal unit 42.

In other words, if there is a block which satisfies Condition 4, there is no ejection in that block, and there is to be no ejection in the blocks corresponding to the distance which is substantially equal to the distance in the paper feed direction between the solvent removal unit 42 and the print head 50 which is situated on the downstream side following the block in terms of the paper feed direction, then the solvent removal flag is made to be on for the block in question, the conveyance speed of the recording paper 16 is increased, and the control is carried out so that the block satisfy Condition 2 shown in FIG. 9.

On the other hand, at step S30, if ink is to be ejected in the plurality of blocks included in the range of R(1 to n, v1+1 to v2) (YES judgment), then the ejection frequency of each nozzle is calculated on the basis of the image data, and the procedure then advances to step S38.

At step S38, it is determined whether the maximum ejection frequency of the blocks contained in the range R (1 to n, v1+1 to v2), f0, is less than the maximum allowable frequency of the print head 50, fmax, or not. If "f0≧fmax" is satisfied (NO judgment), then an alarm is issued to the user (step S46). If "f0<fmax" is satisfied, then the procedure advances to step S40, and it is determined whether Condition 2 would be satisfied if the conveyance speed is increased by (fmax/f0) times or not. The alarm may be issued on the basis of an alarm sound, or voice announcement, and text information or the like may be displayed on the display device if the apparatus has a display device, such as a monitor panel.

At step S40, if Condition 2 would not be satisfied even if the conveyance speed is increased by a factor of (fmax/f0) (NO judgment), then the procedure advances to step S46, whereas if Condition 2 would be satisfied if the conveyance speed is increased by (fmax/f0), then a solvent removal flag is made to be on for the block R (u1, v1) (step S42), and a linear speed increase flag and ejection frequency increase flag are made to be on for the blocks contained in the range of R (1 to n, v1 to v2) (step S44), whereupon the procedure advances to a print operation at step S52.

Figure 16:
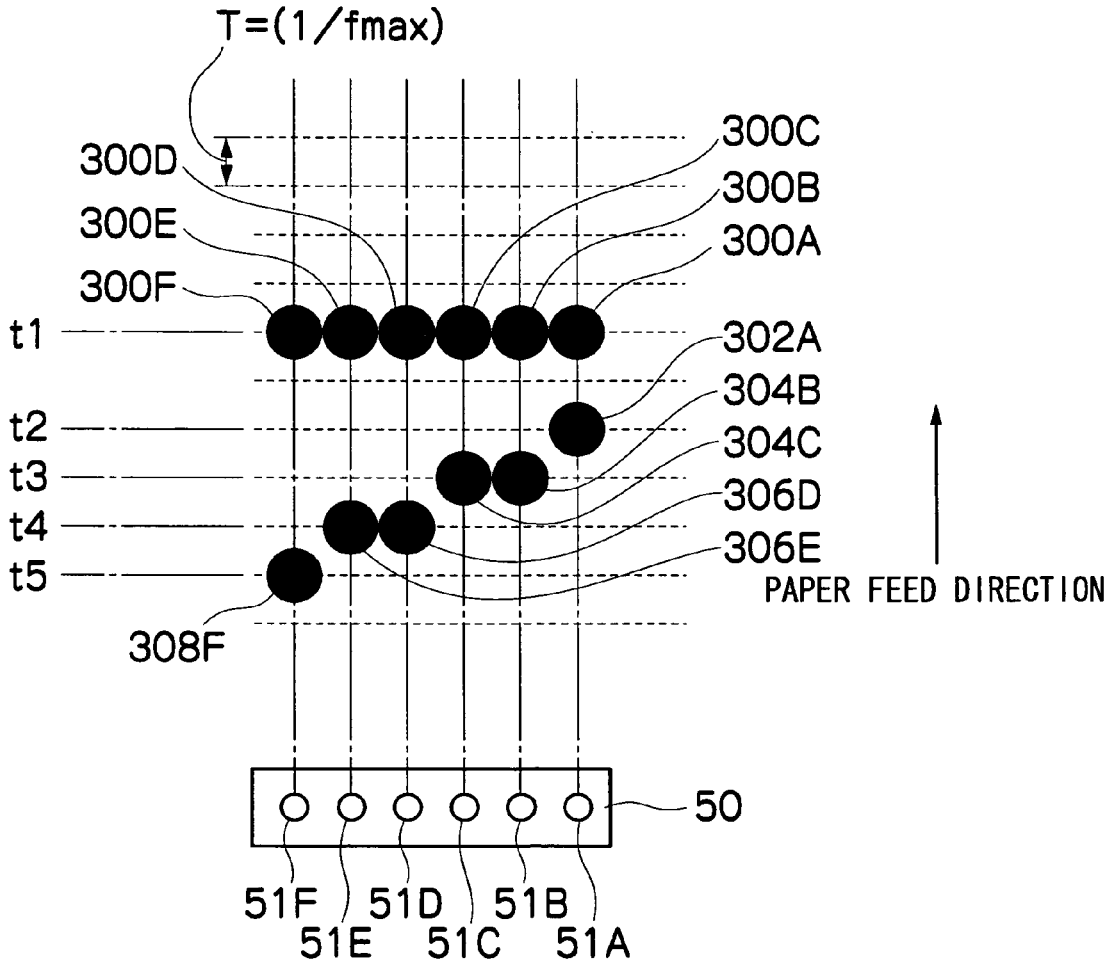
FIG. 16 is a diagram showing the maximum allowable frequency.

The relationships between the maximum allowable frequency f0 of the print head 50 and the conveyance speed, and between the maximum allowable frequency f0 of the print head 50 and the maximum ejection frequency are described below with reference to FIG. 16. FIG. 16 shows dots (image) formed by ink droplets ejected from a print head 50" having six nozzles, nozzle 51A to nozzle 51F (namely, one nozzle row aligned in a main scanning direction which is substantially perpendicular to the paper feed direction).

The dots 300A and 302A are dots formed by ink droplets ejected from the nozzle 51A, the dot 300B and the dot 304B are formed by ink droplets ejected from the nozzle 51B, the dot 300C and the dot 304C are formed by ink droplets ejected from the nozzle 51C, the dot 300D and the dot 306D are formed by ink droplets ejected from the nozzle 51D, the dot 300E and the dot 306E are formed by ink droplets ejected from the nozzle 51E, and the dot 300F and the dot 308F are formed by ink droplets ejected from the nozzle 51F.

Furthermore, the ink droplets forming the dots 300A to 300F are ejected at timing t1, the ink droplet forming the dot 302A is ejected at timing t2, the ink droplets forming the dots 304B and 304C are ejected at timing t3, the ink droplets forming the dots 306D and 306E are ejected at timing t4, and the ink droplet forming the dot 308F is ejected at timing t5.

Furthermore, in the example shown in FIG. 16, dots are formed on the lattice indicated by the broken lines (the points of intersection of the vertical and horizontal broken lines).

In this case, the shortest ejection cycle of the print head 50" corresponds to the length T in the vertical direction of the lattice shown by the broken lines, and the reciprocal of this value indicates the maximum allowable frequency f0 of the print head 50".

For example, in the example shown in FIG. 16, if the maximum allowable frequency fmax of the head 50" is equal to 10 kHz (i.e., fmax=10 kHz), then the ejection frequency f0 of the nozzle 51A is 5 kHz (=1/(t2−t1)), and the ejection frequency of the nozzle 51F is 2 kHz (=1/(t5−t1)). Therefore, it can be seen that the linear speed of the recording paper 16 can be increased by a factor of two (=maximum allowable frequency 10 kHz/maximum ejection frequency 5 kHz).

At step S40, it is determined whether the block in question satisfies Condition 2 or not on the basis of the linear speed thus determined. If Condition 2 is satisfied, then a solvent removal flag is made to be on for that block, and a linear speed increase flag and ejection frequency increase flag are made to be on for the prescribed neighboring region(s) of that block.

Furthermore, if a prescribed print (image recording) operation is carried out at step S52 shown in FIG. 13, then the solvent removal flags (solvent removal blocks) are determined (step S54). The solvent removal is carried out for the solvent removal blocks for which a solvent removal flag has been on, whereas the solvent removal is not carried out for the solvent non-removal blocks for which a solvent removal flag has not been on, and the print control then terminates (step S62).

At step S48 shown in FIG. 13, the user selects whether to print at reduced ink ejection volume (deposition volume) or not in accordance with step S46 in FIG. 12. As a mode of reducing the ink ejection volume, it is possible to change the print mode (e.g., change the high-quality mode to the normal mode, the high-speed mode, or the like), for instance.

If it is selected at step S48 in FIG. 13 to print at reduced ink ejection volume (YES judgment), then the print data (dot data) is changed in such a manner that the ejection frequency becomes equal to or less than the maximum allowable frequency (step S50). As a mode of changing the print data at step S50, there is a method of thinning out the dots in accordance with prescribed rules.

If the print data has been changed at step S50, then the procedure advances to step S52, and printing is carried out on the basis of the changed print data.

On the other hand, if it is not selected at step S48 to print at reduced ink ejection volume, then the control is implemented in such a manner that it is selected whether to change the recording paper (media) 16 or not (step S58). In this case, a report indicating that the media needs to be changed is issued to the user, in such a manner that the user can select whether to change the media or not.

If the media is changed at step S58 (YES judgment), then the procedure returns to step S12 in FIG. 11 after the media has been changed. If the media is not changed at step S58 in FIG. 13 (NO judgment), then the print control operation is suspended (step S60), and the print control is then terminated (step S62).

As a mode of reporting the change of media to the user, it is possible to use an alarm sound, voice announcement, or the like, or to provide a display device, such as an LCD monitor or LED monitor, in such a manner that a display enabling the user to select whether to change the media or not is shown on the display device.

Block Division: Specific Embodiment 1

Next, a specific example of the division of blocks is described below.

Figure 17:
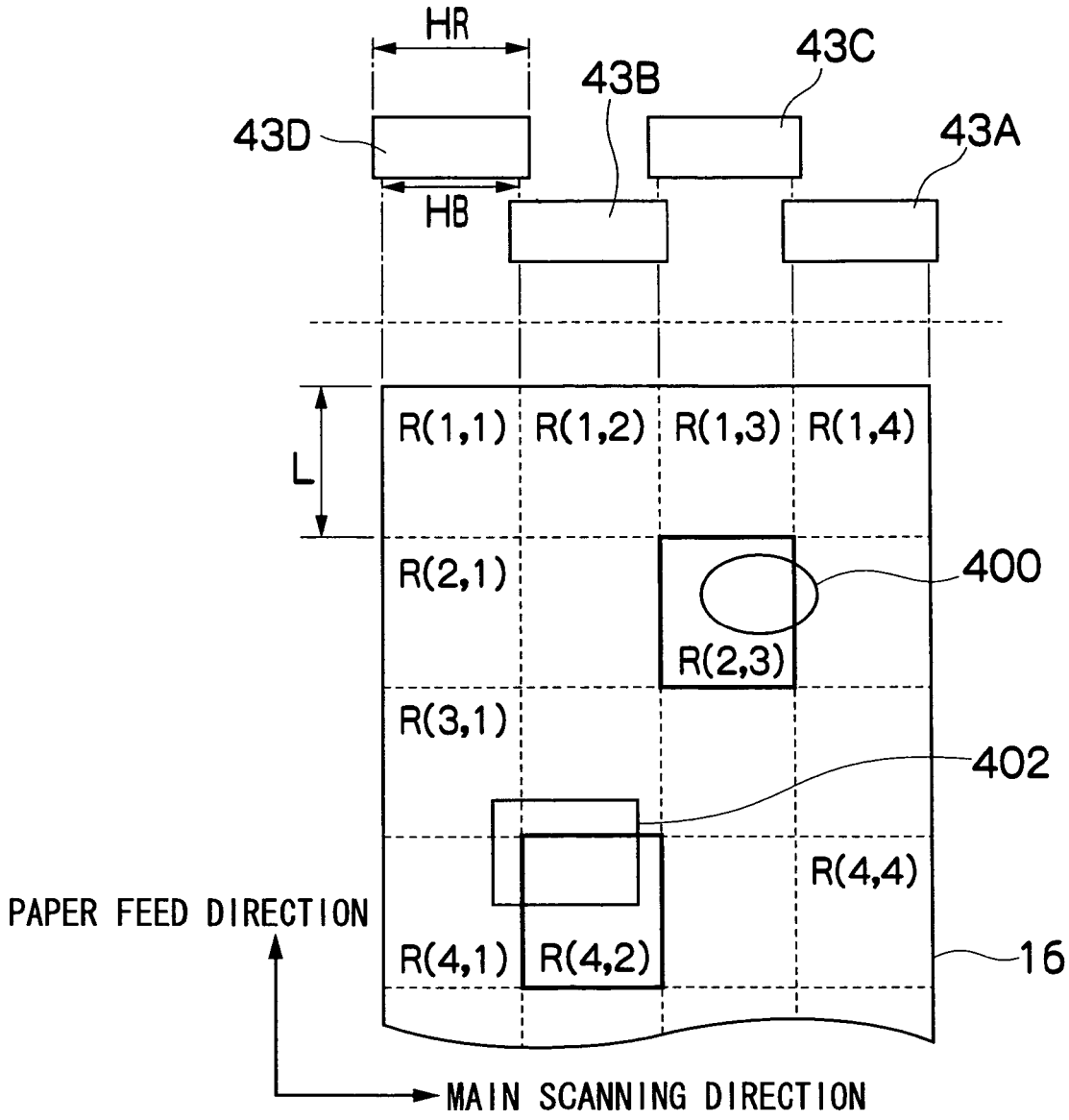
FIG. 17 is a diagram showing another example of the block dividing method shown in FIG. 14.

FIG. 17 shows an example where the width in the main scanning direction of each block established on the recording paper 16 is determined according to the width of the absorbing rollers 43. FIGS. 18 to 21 show an example where regions corresponding to a high solvent volume are extracted on the basis of the image data, and the blocks are established on the recording paper 16 on the basis of these extracted regions.

As shown in FIG. 17, the width HB in the main scanning direction of each block (R (1, 1) to R (4, 4), . . . ) is set to be slightly smaller than the width HR in the main scanning direction of the absorbing rollers 43. The length L of each block in the paper feed direction is determined from the viewpoint of cockling effects. It is desirable that the size of each block shown in FIG. 17 be changed in accordance with the type of recording paper 16, since this allows the solvent removal to be carried out with good accuracy.

In the present example, in the case of art papers or coated papers which are more susceptible to the occurrence of cockling than photographic papers, L is set to 20 mm (i.e., L=20 mm), whereas in the case of photographic paper, in which clocking is relatively unlikely to occur, L is set to a larger distance than 20 mm (i.e., L>20 mm).

The droplet ejection volumes corresponding to the blocks R (1,1) to R (4, 4), . . . , which are set in the above-mentioned way, are calculated. The solvent removal flag are made to be on for a block(s) on the basis of the result of a comparison between the droplet ejection volume and the solvent volume threshold value shown in FIG. 9. In FIG. 17, the solvent removal flags are made to be on for the blocks R (2, 3) and R (4, 2) indicated by the solid lines, which include a picture 400 and a picture 402. The term "picture" here means an image having a continually high droplet ejection volume, and the "picture" includes a photographic image and solid printing area, for example.

If the block dividing method shown in FIG. 17 is used, then the control algorithm is simplified and shortening of the various calculation times can be expected because the width of each block corresponds to the width of the absorbing roller 43. With this method, there may be concerns in that it is difficult to cope with local excesses of the solvent; however, it is suitable for cases where high accuracy is not required in solvent removal, since the complexity of the control operation is relatively simple.

Block Division: Specific Embodiment 2

Next, a further example of dividing the blocks is described below with reference to FIGS. 18 to 21. In this block division method, firstly, regions having continuously high solvent volume, such as pictures, are extracted, whereupon the size of the blocks is determined so as to correspond to these regions.

Figure 18:
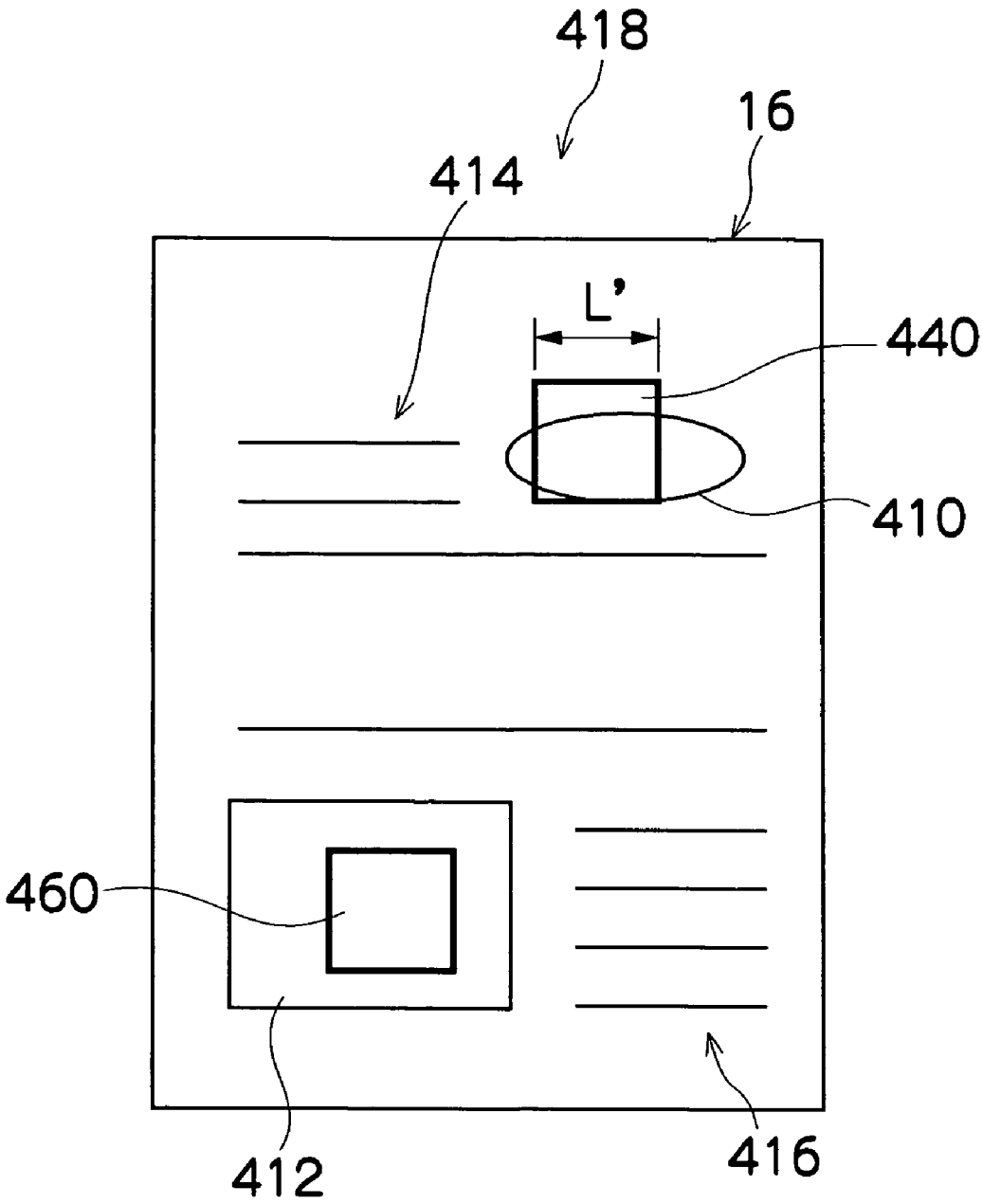
FIG. 18 is a diagram showing another example of the block dividing method shown in FIG. 14.

FIG. 18 shows an image 418 including pictures 410 and 412, and text areas 414 and 416. The term "image" here does not simply refer to an image in the sense of a photograph or picture, but also includes images in a wider sense, such as text images containing text characters, symbols, pictorial characters and the like, and line images.

The pictures 410 and 412 are extracted from the image 418 shown in FIG. 18, and square-shaped blocks R (x, y) (reference numerals 440 and 460) having edges of length L' are set for these pictures 410 and 412. The length of each edge of the blocks R (x, y) shown in FIG. 18 is determined in view of cockling effects, similarly to the length L in the paper feed direction of the blocks shown in FIG. 17.

The solvent volume is calculated for each of the blocks R (x, y) thus established. If the solvent volume is greater than the solvent volume threshold value, then a solvent removal flag is made to be on for the corresponding block R (x, y).

Figure 19:
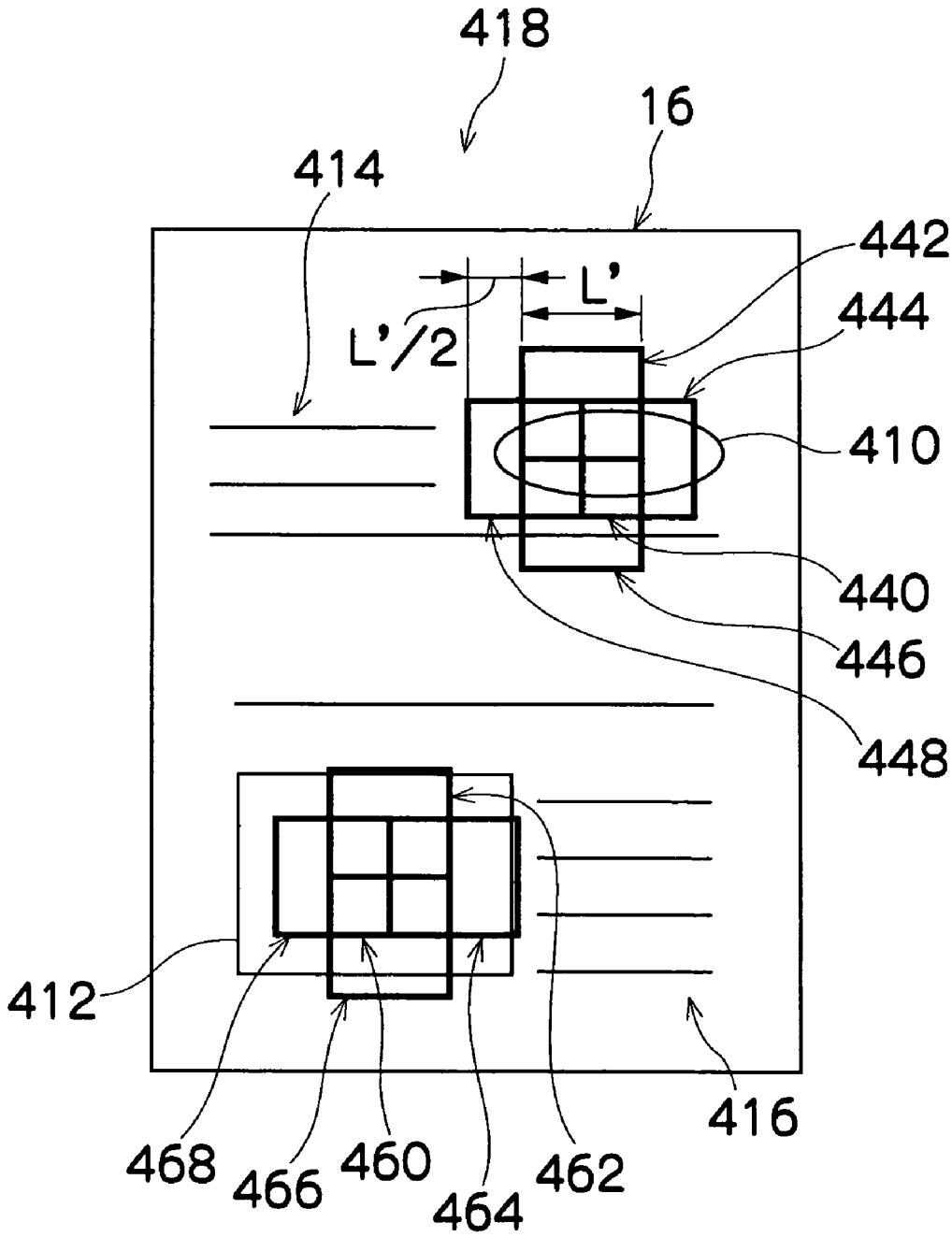
FIG. 19 is a diagram showing another example of the block dividing method shown in FIG. 14.

Next, as shown in FIG. 19, the blocks 442, 444, 446 and 448 shifted by L'/2 to the upper, lower, right-hand and left-hand sides of the block 440 are established, and the solvent volume of each of these blocks is calculated. If the solvent volume thus calculated is greater than the solvent volume threshold value, then the solvent removal flag is made to be on for the corresponding block.

Furthermore, similar processing is also carried out with respect to the block 460 in FIG. 19. In other words, blocks 462, 464, 466 and 468 shifted by L'/2 to the upper, lower, left-hand and right-hand sides of the block 460 are established, and the solvent volume is calculated for each of these blocks. If the solvent volume thus calculated is greater than the solvent volume threshold value, then the solvent removal flag is made to be on for the corresponding block.

Figure 20:
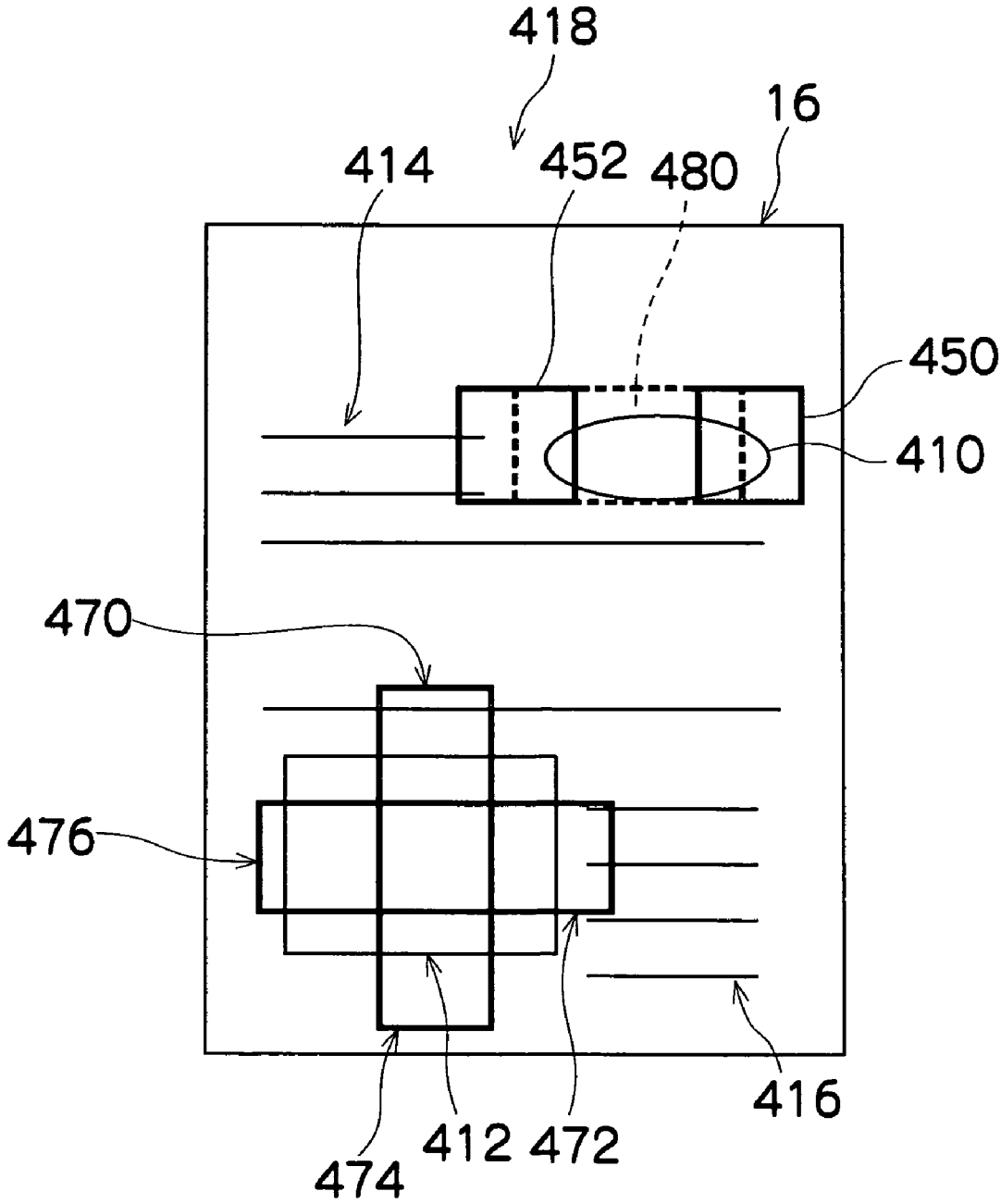
FIG. 20 is a diagram showing another example of the block dividing method shown in FIG. 14.

In this way, as shown in FIG. 20, the processing is continued until the picture 410 is covered by the blocks R (x, y). The blocks 450 and 452 are established for the picture 410. If the processing that a solvent removal flag is made to be on or off has been completed on the basis of a comparison between the solvent volume of these blocks 450 and 452 and the solvent volume threshold value, then the judgment process for solvent removal in picture 410 in FIG. 20 ends. Reference numeral 480 shown by the broken line in FIG. 20 collectively indicates a plurality of blocks for which the solvent removal flag has been made to be on, in correspondence to the picture 410.

Moreover, for the picture 412, the determination of whether to perform solvent removal or not is continued until the picture 412 is covered by the blocks R (x, y). The reference numerals 470, 472, 474 and 476 shown in FIG. 20 indicate blocks moved by a further distance of L'/2 to the upper, lower, left-hand and right-hand sides of the blocks 462, 464, 466 and 468.

Figure 21:
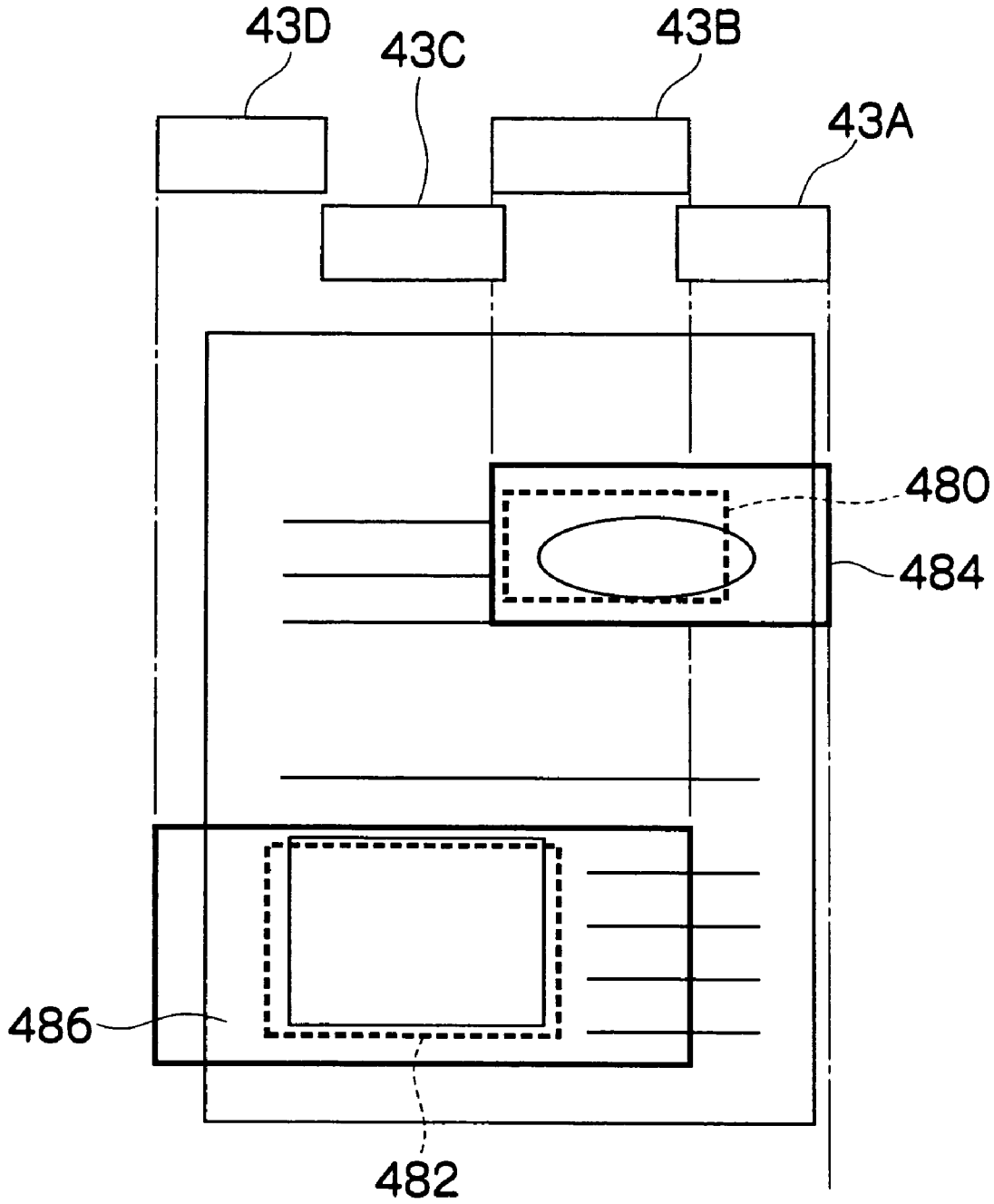
FIG. 21 is a diagram showing another example of the block dividing method shown in FIG. 14.

In FIG. 21, if the plurality of blocks 480 and 482 for which the solvent removal flag is on have been established (as indicated by the broken lines in FIG. 21), then the solvent removal is carried out by using the absorbing rollers 43. In the case of a region which spans two absorbing rollers 43, the solvent removal is performed by the absorbing rollers 43. In other words, the regions 484 and 486 shown in FIG. 21 indicate the regions where solvent removal is actually carried out with respect to the pictures 410 and 412. The solvent removal for the picture 410 is carried out by using the absorbing rollers 43A and 43B, while the solvent removal for the picture 412 is carried out by using the absorbing rollers 43B, 43C, and 43D.

According to the above-described solvent removal where regions having high solvent volume is extracted on the basis of the image data (ejection data), if one block contains both of a region of high solvent volume and a region of low solvent volume, for example, then the concerns that a block which should receive the solvent removal may be overlooked because such solvent volumes are averaged can be resolved. Hence, the solvent removal can be implemented highly accurately.

Although a mode where lattice-shaped blocks are established on the recording paper 16 or image (for example, the image 418) is described in the present example, these blocks may also adopt a rectangular shape (for example, the block divisional is carried out only in the direction in which the absorbing rollers 43 are divided, and is not carried out in the direction substantially perpendicular to the direction in which the absorbing rollers 43 are divided).

In the inkjet recording apparatus 10 having the composition described above, a solvent volume threshold value, which is a threshold value for the volume of solvent at which an unacceptable level of cockling occurs, and a permeation time threshold value, which is a threshold value for the time period until the occurrence of cockling, are established in accordance with the type of recording paper 16 used. Moreover, it is determined whether to implement solvent removal or not, on the basis of comparisons between the solvent volume on the recording paper 16 and the solvent volume threshold value and between the solvent volume on the recording paper 16 and the permeation time threshold value. Furthermore, if the characteristics exceed both the solvent volume threshold value and permeation time threshold value, then the ejection conditions, such as the ink ejection volume, the conveyance speed of the recording paper 16, the ejection frequency, the type of recording paper 16, and the like, are changed. Consequently, the solvent removal corresponding to the type of recording paper 16 is carried out, and a desirable image which does not contain cockling of an unacceptable level can be obtained on the recording paper 16.

In the present embodiment, a two-liquid type inkjet recording apparatus is described, which promotes the fixing of the ink onto the recording paper 16 by making the ink react with a treatment liquid; however, the applicable scope of the present invention is not limited to a two-liquid type inkjet recording apparatus. The present invention may also be applied to a single-liquid type inkjet recording apparatus which records images onto recording paper 16 by using a pigment-based ink or a dye-based ink. In an inkjet recording apparatus using a single-liquid type of ink, a system for separating the coloring material from the solvent when the ink lands on the recording paper 16, may be incorporated into the recording paper 16, for example.

It should be understood that there is no intention to limit the invention to the specific forms disclosed, but on the contrary, the invention is to cover all modifications, alternate constructions and equivalents falling within the spirit and scope of the invention as expressed in the appended claims.

What is claimed is:

1. An image recording apparatus, comprising:

a liquid ejection head which ejects liquid onto a recording medium;

a conveyance device which relatively conveys the recording medium with respect to the liquid ejection head, by moving at least one of the recording medium and the liquid ejection head;

a liquid removal device which is provided after the liquid ejection head in terms of a conveyance direction of the recording medium and removes the liquid on the recording medium;

a recording medium determination device which determines a type of the recording medium;

a liquid volume determination device which determines a volume of the liquid on the recording medium;

a liquid volume threshold value establishment device which establishes a liquid volume threshold value in accordance with the type of the recording medium determined by the recording medium determination device; and a liquid removal control device which controls the liquid removal device in accordance with a comparison between the volume of the liquid on the recording medium determined by the liquid volume determination device and the liquid volume threshold value established by the liquid volume threshold value establishment device.

2. The image recording apparatus as defined in claim 1, further comprising an ejection control device which controls a volume of the liquid ejected from the liquid ejection head, in such a manner that, if the volume of the liquid on the recording medium determined by the liquid volume determination device exceeds the liquid volume threshold value, then the volume of the liquid ejected from the liquid ejection head becomes equal to or lower than the liquid volume threshold value.

3. The image recording apparatus as defined in claim 1, further comprising a dividing device which divides a region on the recording medium into a plurality of blocks, the region having possibility of receiving the ejected liquid;

wherein the liquid volume determination device determines the volume of the liquid ejected from the liquid ejection head, for each of the blocks of the recording medium obtained by the dividing device; and the liquid removal control device performs control in such a manner that a liquid removal is carried out in accordance with the volume of the liquid determined for each of the blocks.

4. The image recording apparatus as defined in claim 1, wherein:

a plurality of the liquid removal devices which are arranged in a direction substantially perpendicular to a direction in which the recording medium is relatively conveyed, are provided; and the liquid removal control device performs control in such a manner that a liquid removal is carried out for each of the liquid removal devices.

5. The image recording apparatus as defined in claim 1, wherein:

a plurality of the liquid ejection heads are provided; and the liquid ejection heads include an ink ejection head which ejects ink and a treatment liquid ejection head which ejects treatment liquid that promotes fixing of the ink onto the recording medium.

6. An image recording apparatus, comprising:

a liquid ejection head which ejects liquid onto a recording medium;

a conveyance device which relatively conveys the recording medium with respect to the liquid ejection head, by moving at least one of the recording medium and the liquid ejection head;

a liquid removal device which is provided after the liquid ejection head in terms of a conveyance direction of the recording medium and removes the liquid on the recording medium;

a recording medium determination device which determines a type of the recording medium;

a liquid removal time calculation device which calculates a liquid removal time until the liquid ejected from the liquid ejection head is removed from the recording medium;

a liquid removal time threshold value establishment device which establishes a threshold value for the liquid removal time in accordance with the type of the recording medium determined by the recording medium determination device; and a conveyance control device which controls a conveyance speed of the recording medium in accordance with a comparison between the liquid removal time calculated by the liquid removal time calculation device and the liquid removal time threshold value established by the liquid removal time threshold value establishment device.

7. The image recording apparatus as defined in claim 6, further comprising an ejection control device which controls an ejection frequency of the liquid ejection head in accordance with the conveyance speed of the recording medium.

8. The image recording apparatus as defined in claim 6, further comprising a dividing device which divides a region on the recording medium into a plurality of blocks, the region having possibility of receiving the ejected liquid;

wherein the liquid volume determination device determines the volume of the liquid ejected from the liquid ejection head, for each of the blocks of the recording medium obtained by the dividing device; and the liquid removal control device performs control in such a manner that a liquid removal is carried out in accordance with the volume of the liquid determined for each of the blocks.

9. The image recording apparatus as defined in claim 6, wherein:

a plurality of the liquid removal devices which are arranged in a direction substantially perpendicular to a direction in which the recording medium is relatively conveyed, are provided; and the liquid removal control device performs control in such a manner that a liquid removal is carried out for each of the liquid removal devices.

10. The image recording apparatus as defined in claim 6, wherein:

a plurality of the liquid ejection heads are provided; and the liquid ejection heads include an ink ejection head which ejects ink and a treatment liquid ejection head which ejects treatment liquid that promotes fixing of the ink onto the recording medium.

11. An image recording apparatus, comprising:

a liquid ejection head which ejects liquid onto a recording medium;

a conveyance device which relatively conveys the recording medium with respect to the liquid ejection head, by moving at least one of the recording medium and the liquid ejection head;

a liquid removal device which is provided after the liquid ejection head in terms of a conveyance direction of the recording medium and removes the liquid on the recording medium;

a recording medium determination device which determines a type of the recording medium;

a liquid volume determination device which determines a volume of the liquid on the recording medium;

a liquid volume threshold value establishment device which establishes a liquid volume threshold value in accordance with the type of the recording medium determined by the recording medium determination device;

a liquid removal control device which controls the liquid removal device in accordance with a comparison between the volume of the liquid on the recording medium determined by the liquid volume determination device, and the liquid volume threshold value established by the liquid volume threshold value establishment device;

a liquid removal time calculation device which calculates a liquid removal time until the liquid ejected from the liquid ejection head is removed from the recording medium;

a liquid removal time threshold value establishment device which establishes a threshold value for the liquid removal time in accordance with the type of the recording medium determined by the recording medium determination device; and a conveyance control device which controls a conveyance speed of the recording medium in accordance with a comparison between the liquid removal time calculated by the liquid removal time calculation device and the liquid removal time threshold value established by the liquid removal time threshold value establishment device.

12. The image recording apparatus as defined in claim 11, further comprising an ejection control device which controls a volume of the liquid ejected from the liquid ejection head, in such a manner that, if at least one of a condition where the volume of the liquid determined by the liquid volume determination device exceeds the liquid volume threshold value, and a condition where the liquid removal time calculated by the liquid removal time calculation device exceeds the threshold value for the liquid removal time, is satisfied, then the volume of the liquid ejected from the liquid ejection head becomes equal to or lower than the liquid volume threshold value.

13. The image recording apparatus as defined in claim 12, wherein the ejection control device controls an ejection frequency of the liquid ejection head in accordance with the conveyance speed of the recording medium.

14. The image recording apparatus as defined in claim 11, further comprising a dividing device which divides a region on the recording medium into a plurality of blocks, the region having possibility of receiving the ejected liquid;

wherein the liquid volume determination device determines the volume of the liquid ejected from the liquid ejection head, for each of the blocks of the recording medium obtained by the dividing device; and the liquid removal control device performs control in such a manner that a liquid removal is carried out in accordance with the volume of the liquid determined for each of the blocks.

15. The image recording apparatus as defined in claim 11, wherein:

a plurality of the liquid removal devices which are arranged in a direction substantially perpendicular to a direction in which the recording medium is relatively conveyed, are provided; and the liquid removal control device performs control in such a manner that a liquid removal is carried out for each of the liquid removal devices.

16. The image recording apparatus as defined in claim 11, wherein:

a plurality of the liquid ejection heads are provided; and the liquid ejection heads include an ink ejection head which ejects ink and a treatment liquid ejection head which ejects treatment liquid that promotes fixing of the ink onto the recording medium.

* * * * *